US010570906B2

(12) United States Patent
Leal

(10) Patent No.: US 10,570,906 B2
(45) Date of Patent: Feb. 25, 2020

(54) MIXED FLOW FAN

(71) Applicant: TTI (MACAO COMMERCIAL OFFSHORE) LIMITED, Macau (MO)

(72) Inventor: Eric G. Leal, Anderson, SC (US)

(73) Assignee: TTI (MACAO COMMERCIAL OFFSHORE) LIMITED, Macau (MO)

( * ) Notice: Subject to any disclaimer, the term of this patent is extended or adjusted under 35 U.S.C. 154(b) by 235 days.

(21) Appl. No.: 15/587,433

(22) Filed: May 5, 2017

(65) Prior Publication Data

US 2017/0321705 A1 Nov. 9, 2017

Related U.S. Application Data

(60) Provisional application No. 62/332,348, filed on May 5, 2016.

(51) Int. Cl.
*F04D 17/16* (2006.01)
*F04D 29/28* (2006.01)
(Continued)

(52) U.S. Cl.
CPC ..... *F04D 17/165* (2013.01); *F04D 17/06* (2013.01); *F04D 17/16* (2013.01); *F04D 29/023* (2013.01);
(Continued)

(58) Field of Classification Search
CPC ..... F04D 17/06; F04D 17/16; F04D 17/165; F04D 29/023; F04D 29/281;
(Continued)

(56) References Cited

U.S. PATENT DOCUMENTS 2,902,941 A * 9/1959 Kiba ..... F04D 29/2227 416/186 R
3,047,211 A 7/1962 Hay
(Continued)

FOREIGN PATENT DOCUMENTS

JP 2013024102 8/2000
JP 2011202560 A * 10/2011
(Continued)

OTHER PUBLICATIONS

Australian Patent Office Examination Report for Application No. 2017202992 dated May 4, 2018, 3 pages.

*Primary Examiner* — John M Zaleskas
(74) *Attorney, Agent, or Firm* — Michael Best & Friedrich LLP

(57) ABSTRACT

A mixed flow fan and a method of manufacturing a mixed flow fan. The method may include molding a fan wheel with a plurality of blades and a plurality of apertures. The plurality of blades extends radially outward from an axis of rotation and a plurality of apertures arranged with one aperture positioned between each pair of adjacent blades. The method also includes molding a plug having a conical shape. The plug includes a plurality of plugging members arranged circumferentially, where the number of the plurality of plugging members corresponds to the number of the plurality of apertures in the fan wheel. The method further includes welding together the fan wheel and the plug, where each of the plurality of apertures of the fan wheel is sealed by one of the plurality of plugging members of the plug to form a continuous surface.

18 Claims, 16 Drawing Sheets

(51) Int. Cl.
*F04D 29/32* (2006.01)
*F04D 29/02* (2006.01)
*F04D 17/06* (2006.01)

(52) U.S. Cl.
CPC ..... *F04D 29/281* (2013.01); *F04D 29/325* (2013.01); *F05D 2230/232* (2013.01)

(58) Field of Classification Search
CPC .... F04D 29/325; F04D 29/329; F04D 29/624; F04D 29/626; F04D 29/644; F04D 29/646; F05D 2230/232
USPC ..... 416/234
See application file for complete search history.

(56) References Cited

U.S. PATENT DOCUMENTS 3,173,604 A 3/1965 Sheets
3,794,443 A 2/1974 McCarty
4,211,514 A 7/1980 Hawes
4,364,712 A 12/1982 Charles
4,893,990 A 1/1990 Tomohiro
5,387,087 A 2/1995 Chen
5,895,206 A 4/1999 Chuang
6,042,335 A 3/2000 Amr
6,082,969 A 7/2000 Carroll
6,276,899 B1 * 8/2001 Lambert ..... B23H 9/10 29/889.2
6,494,681 B2 12/2002 Barry
6,547,517 B1 4/2003 Fenner
6,877,955 B2 4/2005 Higashimori
6,935,843 B2 8/2005 Wang
7,360,992 B2 4/2008 Cho
7,856,834 B2 12/2010 Haley
8,052,386 B1 11/2011 Fitzpatrick
8,152,495 B2 4/2012 Boggess, Jr.
8,328,412 B2 12/2012 Higbee
8,974,199 B2 3/2015 Schmid
2002/0110455 A1 8/2002 Kim
2003/0152458 A1 * 8/2003 Iida ..... B29C 45/0062 415/206
2004/0258519 A1 * 12/2004 Kim ..... F04D 29/023 415/206
2005/0163614 A1 * 7/2005 Chapman ..... F04D 29/30 415/206
2005/0254954 A1 11/2005 Higashimori
2007/0110574 A1 * 5/2007 Lu ..... F04D 29/023 415/206
2008/0085188 A1 4/2008 Hanlon
2008/0175730 A1 7/2008 Wysk
2008/0199319 A1 * 8/2008 Mause ..... B29C 65/7814 416/185
2008/0286130 A1 * 11/2008 Purvines ..... B23P 15/006 417/410.1
2010/0074761 A1 * 3/2010 Yang ..... F04D 29/329 416/244 R
2010/0316498 A1 * 12/2010 Cahill ..... F04D 29/023 416/189
2010/0329871 A1 12/2010 Cahill
2011/0318183 A1 * 12/2011 Noronha ..... B23P 15/006 416/189
2012/0121422 A1 * 5/2012 Kim ..... F04D 29/281 416/185
2012/0219437 A1 * 8/2012 Nakamura ..... A47L 5/22 417/423.1
2012/0219440 A1 * 8/2012 Seccareccia ..... F04D 17/16 417/423.14
2013/0302156 A1 11/2013 Nurzynski
2014/0105749 A1 * 4/2014 Pellenc ..... F04D 29/023 416/210 R
2014/0119892 A1 5/2014 Mornan
2014/0241894 A1 8/2014 Brownell
2014/0241920 A1 8/2014 Brownell
2014/0328689 A1 * 11/2014 Ishikawa ..... F04D 29/285 416/223 R
2015/0030457 A1 * 1/2015 Yamamoto ..... F04D 29/023 416/234
2015/0252773 A1 * 9/2015 Skare ..... F03B 3/128 416/223 A
2016/0138404 A1 * 5/2016 Chen ..... F04D 29/281 415/220
2016/0177966 A1 * 6/2016 Kim ..... F04D 17/16 416/234

FOREIGN PATENT DOCUMENTS

JP 2000213493 2/2013
JP 2013024102 A * 2/2013
WO WO-2009065894 A1 * 5/2009 ..... F04D 29/285
WO WO-2011038884 A1 4/2011
WO WO-2014096344 A1 6/2014

* cited by examiner

MIXED FLOW FAN

CROSS-REFERENCE TO RELATED APPLICATION

This application claims priority to U.S. Provisional Application No. 62/332,348, filed May 5, 2016, the entire contents of which are hereby incorporated by reference.

FIELD

Independent embodiments of the invention relate to fans and, specifically, to mixed flow fans.

BACKGROUND

A mixed flow fan is a fan that is capable of moving air in two flow directions. For example, some mixed flow fans can direct air in an axial direction as well as in a radial direction. Mixed flow fans produce more air power per size than other types of fan. Mixed flow fans do not stall like axial fans so they work well in broad operating conditions. In addition, mixed flow fans do not have to be large or run slowly to operate efficiently as do standard centrifugal fans. However, mixed flow fans cannot be easily manufactured and are much more complex to design than the other fan styles.

SUMMARY

In one independent embodiment, a fan may generally include a fan wheel having a frustoconical shape with a first circumference on a first end and a second circumference on a second end, where the second circumference is greater than the first circumference. An axis of rotation of the fan wheel extends through the first end and the second end. A plurality of blades extends radially outward from the axis of rotation. Each of the plurality of blades has a leading end and a trailing end, in which the leading end is radially inward of the trailing end. The plurality of blades is spaced apart by a plurality of apertures. A plug is configured to engage the fan wheel. The plug includes a plurality of plugging members positioned to align with the plurality of apertures such that when the plug is engaged with the fan wheel each plugging member is inserted into one of the plurality of apertures. The plurality of plugging members are each sized and shaped to seal the corresponding aperture to form a continuous surface between each pair of adjacent blades.

In another independent embodiment, a method of manufacturing a mixed flow fan may be provided. The method may generally include molding a fan wheel with a plurality of blades and a plurality of apertures. The plurality of blades extends radially outward from an axis of rotation and a plurality of apertures arranged with one aperture positioned between each pair of adjacent blades. The method also includes molding a plug having a conical shape. The plug includes a plurality of plugging members arranged circumferentially, where the number of the plurality of plugging members corresponds to the number of the plurality of apertures in the fan wheel. The method further includes welding together the fan wheel and the plug, where each of the plurality of apertures of the fan wheel is sealed by one of the plurality of plugging members of the plug to form a continuous surface.

In yet another independent embodiment, a fan may generally include a fan wheel defining an axis of rotation, and a plurality of blades extending radially outward from the axis of rotation. Each of the plurality of blades has a leading end and a trailing end. The leading end is radially inward of the trailing end. The plurality of blades is spaced apart by a plurality of apertures. A plug is configured to engage the fan wheel. The plug includes a plurality of plugging members positioned to align with the plurality of apertures such that when the plug is engaged with the fan wheel each plugging member is inserted into one of the plurality of apertures. The plurality of plugging members are each sized and shaped to seal the corresponding aperture to form a continuous surface between each pair of adjacent blades. An inlet is oriented circumferentially around the axis of rotation, such that the inlet is configured to receive a flow of air in a radial direction. An outlet is oriented parallel with the axis of rotation, such that the outlet is configured to dispel the flow of air in an axial direction.

In a further independent embodiment, a fan may generally include a fan wheel defining an axis of rotation; a plurality of blades extending radially outward from the axis of rotation, each of the plurality of blades having a leading end and a trailing end, the leading end being radially inward of the trailing end, adjacent blades being spaced apart by an aperture; and a plug configured to engage the fan wheel, the plug including a plurality of plugging members, when the plug is engaged with the fan wheel, each plugging member being inserted into a corresponding aperture, each plugging member closing the corresponding aperture to form a continuous surface between adjacent blades.

In another independent embodiment, a method of manufacturing a mixed flow fan may be provided. The method may generally include molding a fan wheel with a plurality of blades extending radially outward from an axis of rotation and a plurality of apertures arranged with one aperture positioned between adjacent blades; molding a plug including a plurality of plugging members arranged circumferentially, a number of the plurality of plugging members corresponding to a number of the plurality of apertures in the fan wheel; and connecting the fan wheel and the plug with each of the plurality of apertures of the fan wheel receiving a corresponding one of the plurality of plugging members of the plug to close the aperture.

In yet another independent embodiment, a fan may generally include a first member forming a first portion of the fan, the first member defining an axis of rotation and including a plurality of blades extending radially outward from the axis of rotation; and a second member formed separately from the first member and forming a second portion of the fan, the second member being connectable to the first member with a portion of the first member and the second member overlapping when viewed along the axis of rotation.

Other independent aspects of the invention will become apparent by consideration of the detailed description, claims and accompanying drawings.

DETAILED DESCRIPTION

Figure 1:
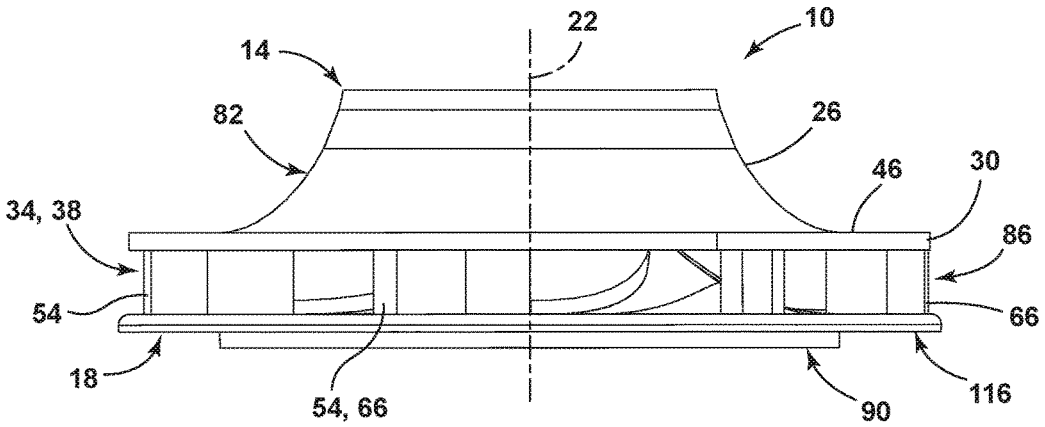
FIG. 1 illustrates a side view of a fan according to one independent embodiment.
Figure 2:
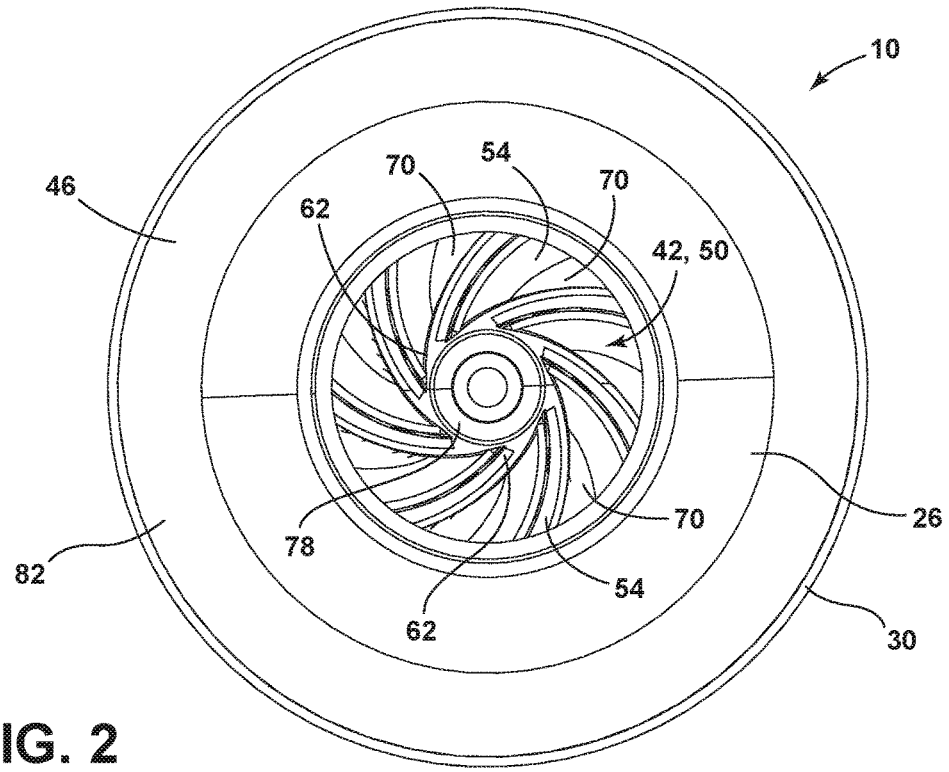
FIG. 2 illustrates a top view of the fan shown in FIG. 1.
Figure 3:
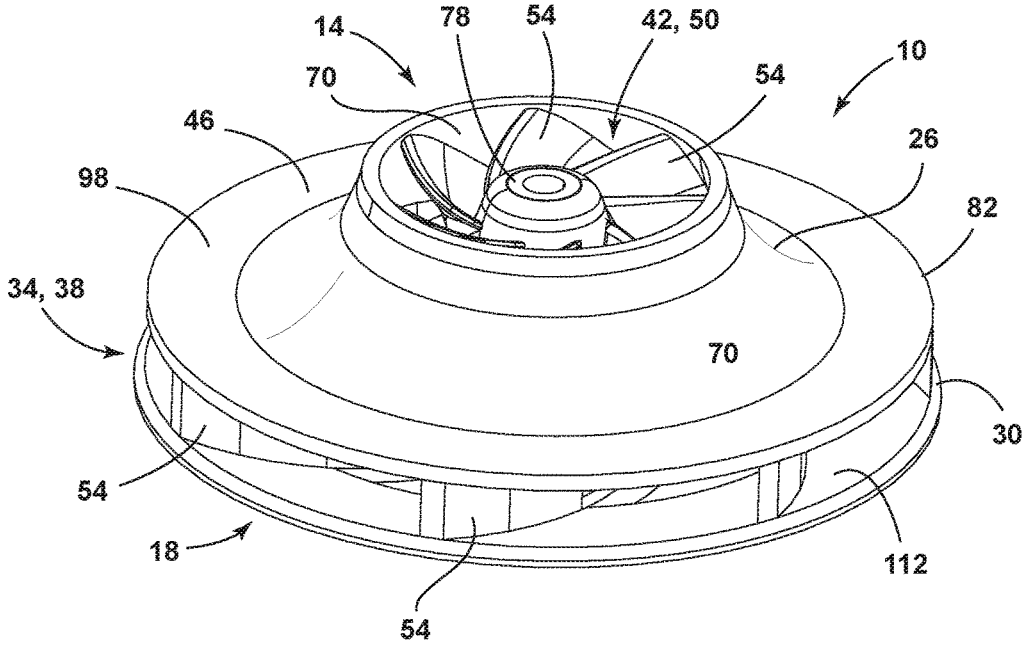
FIG. 3 illustrates a top perspective view of the fan shown in FIG. 1.
Figure 4:
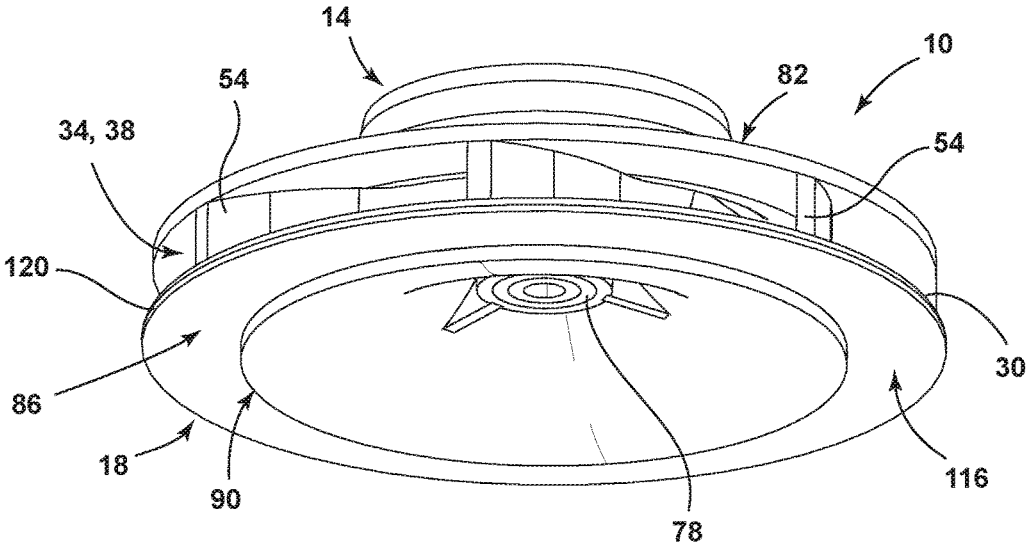
FIG. 4 illustrates a bottom perspective view of the fan shown in FIG. 1.

Before any independent embodiments of the invention are explained in detail, it is to be understood that the invention is not limited in its application to the details of construction and the arrangement of components set forth in the following description or illustrated in the following drawings. The invention is capable of other independent embodiments and of being practiced or of being carried out in various ways. In addition, a device or structure disclosed as being configured in a certain way can be configured in at least that way, but can also be configured in ways that are not listed.

In addition, in the following description, it can be seen that various features are grouped together in various embodiments for the purpose of streamlining the disclosure. This does not mean that the claimed embodiments require more features than are expressly recited in each claim. It only means that inventive subject matter may be encompassed in fewer than all features of a single disclosed independent embodiment or combinations (whether full or partial) of disclosed independent embodiments as set forth in the written description.

Mixed flow fans are capable of creating air flow in more than one direction. For example, mixed flow fans can direct air flow in an axial direction and a radial direction. Often times, mixed flow fans are complex in their design from a manufacturing standpoint. Due to the complexity of the design, many mixed flow fans are manufactured using tedious or expensive methods such as investment casting or 5-axis machining. The mixed flow fan provided herein may be designed in one aspect to improve manufacturability, production time, and/or cost.

FIGS. 1-4 illustrate a mixed flow fan 10 capable of directing a flow of air in both an axial direction and a radial direction. The illustrated fan 10 has a circular cross-section and a frustoconical shape that tapers between a first end 14 having a first circumference and a second end 18 having a second circumference greater than the first circumference. An axis of rotation 22 extends through the center of the fan 10 between the first end 14 and the second end 18. When viewed from the side (FIG. 1), the fan 10 includes an inclined first portion 26 that slopes radially outward and a second portion 30 that has a linear profile with edges that extend parallel with the axis of rotation 22.

An annular opening 34 extends around the second portion 30 of the fan 10 proximate the second end 18. The annular opening 34 defines an outlet 38 of the fan 10. The fan 10 also includes an opening 42, which is circular in the illustrated embodiment, on a top side 46 of the fan 10 proximate the first end 14. The opening 42 defines an inlet 50 of the fan 10.

Blades 54 are provided within the interior of the fan 10. The blades 54 extend between the first end 14 and the second end 18, creating channels 58 (see FIGS. 6 and 7) between each pair of adjacent blades 54. Each blade 54 includes a leading end 62 and a trailing end 66 opposite of the leading end 62. The leading ends 62 divide the opening 42 into inlet partitions 70, and the trailing ends 66 divide the annular opening 34 into outlet partitions 74. Each channel 58 connects an inlet partition 70 with an outlet partition 74. The channels 58 direct the flow of air so that air entering the inlet 50 flows in a substantially axial direction and air exiting through the outlet 38 flows in a substantially radial direction.

Figure 7:
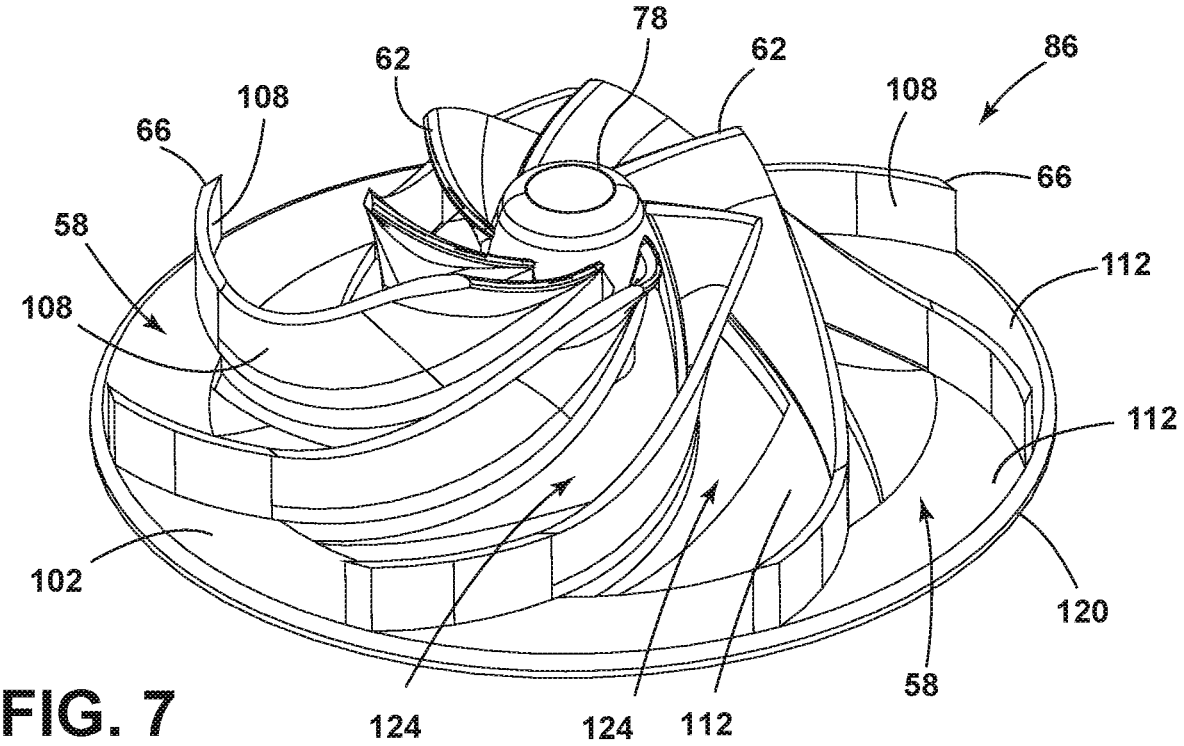
FIG. 7 illustrates a perspective view of the fan wheel shown in FIG. 6.

As shown in FIG. 7, in some embodiments, the blades 54 are curved such that the leading end 62 extends radially outward in a first direction (e.g., perpendicular to the axis of rotation 22) and the trailing end 66 extends axially in a second direction (e.g., parallel to the axis of rotation 22). In addition, the leading ends 62 of the blades 54 are joined together by a cylindrical hub 78 positioned along the axis of rotation 22.

Figure 5:
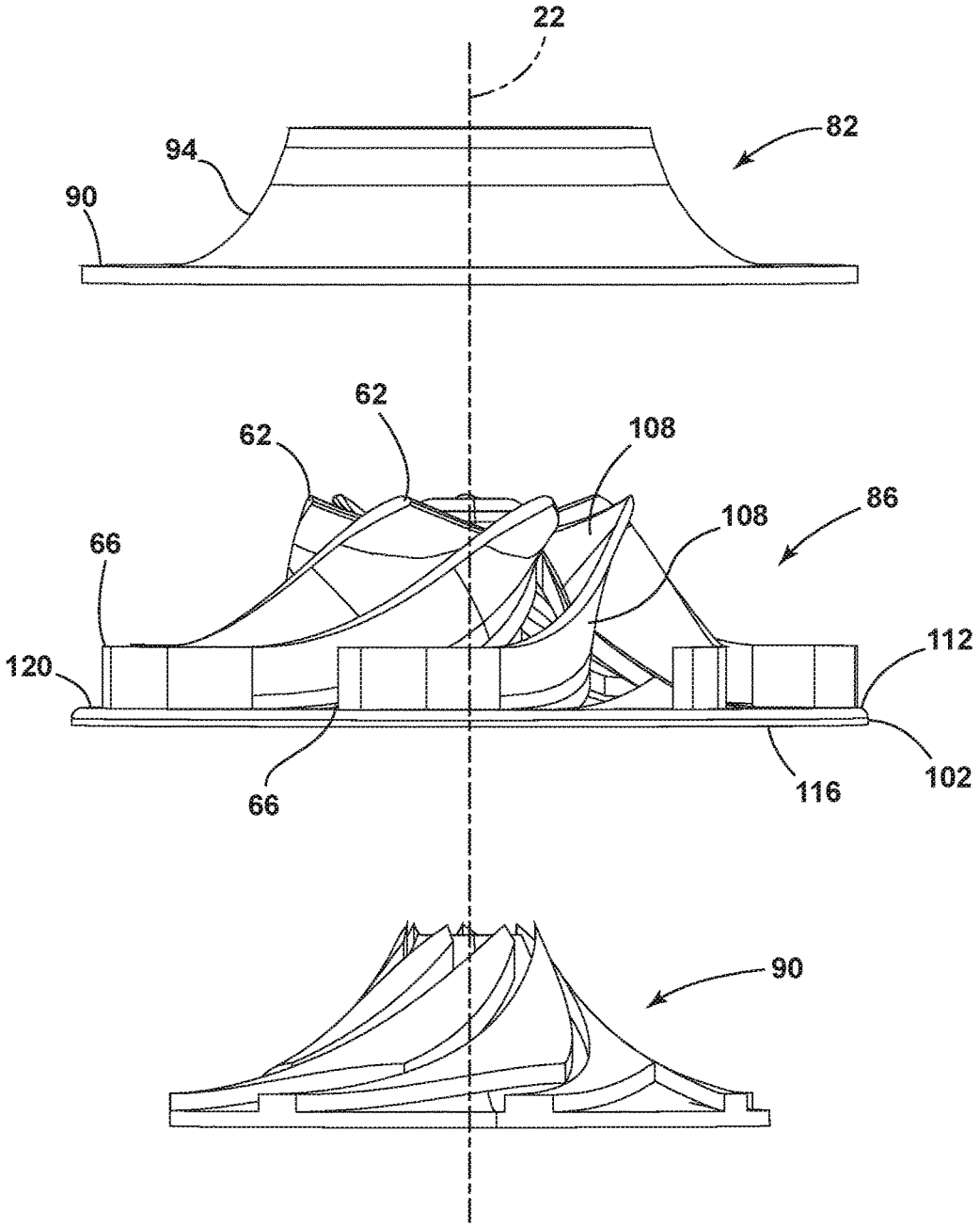
FIG. 5 illustrates an exploded view of the fan shown in FIG. 1.

With reference to the exploded view shown in FIG. 5, the illustrated fan 10 has three separate members, including a shroud 82, a fan wheel 86, and a plug 90 (together "the members"), connected (e.g., welded together) to form the fan 10. The shroud 82 has a frustoconical shape with an outer wall 94 defining the opening 42 on the first end 14 of the fan 10. The outer wall 94 slopes downward and radially outward to define the inclined first portion 26 of the fan 10. The outer wall 94 curves radially outward to form a planar rim 98 at the lower end of the outer wall 94. The rim 98 engages the trailing ends 66 of the blades 54 when the fan 10 is assembled.

Figure 6:
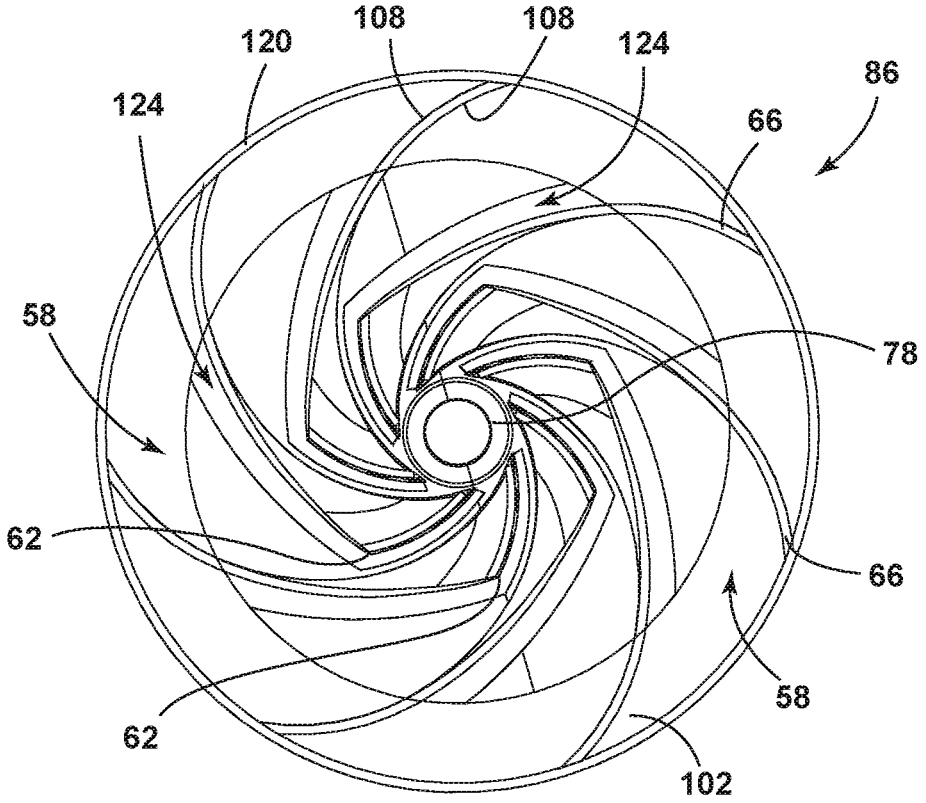
FIG. 6 illustrates a top view of a fan wheel for use with the fan shown in FIG. 1.

As shown in FIGS. 6-7, the fan wheel 86 includes the cylindrical hub 78, the blades 54, and a base plate 102. The blades 54 extend radially outward and axially downward from the cylindrical hub 78 with the leading ends 62 positioned radially inward from the trailing ends 66. Thus, when viewed from the side, the fan wheel 86 has a frustoconical shape. Each blade 54 further includes opposing side surfaces 108 extending between the leading end 62 and the trailing end 66. The air flow channels 58 are formed by the side surfaces 108 of adjacent blades 54 (FIGS. 6 and 7).

In the illustrated embodiment, the blades 54 curve around the axis of rotation 22. The blades 54 also twist so that the side surfaces 108 of the blades 54 do not remain parallel with the axis of rotation 22 for the entire length of the blade 54. In particular, at the trailing end 66 of each blade 54, the side surfaces 108 are parallel with the axis of rotation 22; whereas, at the leading end 62, the side surfaces 108 are positioned at an angle relative to the axis of rotation 22. The curvature of the side surfaces 108 transitions the incoming airflow from a substantially axial direction to a substantially radial direction at the outlet 38. In addition to directing the air flow, the curvature of the blades 54 generates axial and centrifugal pressure at the same time, which also increases the velocity of the air traveling through the channels 58. Furthermore, as shown in FIG. 6, when viewing the blades 54 from a top view (i.e., viewing along the axis of rotation 22), the blades 54 do not overlap one another.

The base plate 102 includes a top surface 112 and a bottom surface 116. The top surface 112 of the base plate 102 supports the blades 54. The base plate 102 extends from the axis of rotation 22 to the trailing ends 66 of the blades 54 on an underside of the blades 54. In the illustrated embodiment, an outer edge 120 of the base plate 102 forms a planar surface that supports the trailing ends 66 of the blades 54. The outer edge 120 aligns generally parallel with the rim 98 of the shroud 82 when the fan 10 is assembled. In the illustrated embodiment, the trailing end 66 of each blade 54 is arranged substantially perpendicular to the outer edge 120. When the fan 10 is assembled, the trailing ends 66 of the blades 54 extend between the outer edge 120 of the base plate 102 and the rim 98 of the shroud 82. The blades 54 support the shroud 82 at a distance from the outer edge 120 of the base plate 102 to form the annular opening 34, and the trailing ends 66 of the blades 54 divide the annular opening 34 into the outlet partitions 74.

The blades 54 are spaced apart by apertures 124 formed within each channel 58. The apertures 124 are located in the base plate 102, with one aperture 124 positioned between adjacent blades 54. In the illustrated embodiment, the apertures 124 extend at least partially along the side surface 108 of each blade 54. As shown in FIGS. 6-7, each aperture 124 is axially covered by a portion of an adjacent one of the blades 54.

In some embodiments, each aperture 124 spans the entire width and/or length of the channels 58. In other embodiments, the apertures 124 only span a portion of the channels 58, leaving a portion of the top surface 112 of the base plate 102 visible between adjacent blades 54. The shapes and sizes of the apertures 124 may vary within a single base plate 102 or may vary from base plate 102 to base plate 102.

Figure 8:
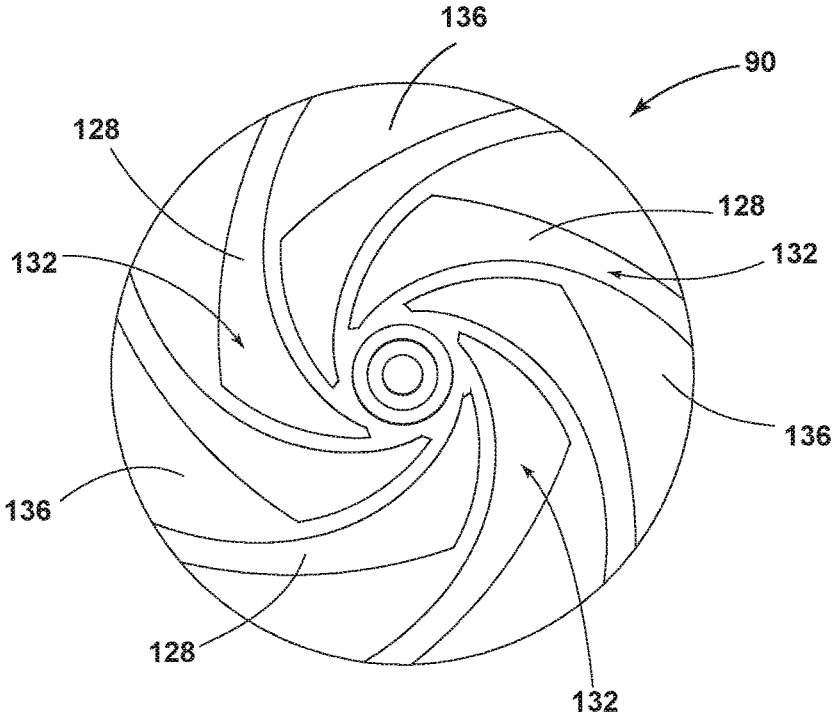
FIG. 8 illustrates a top view of a plug for use with the fan shown in FIG. 1.
Figure 9:
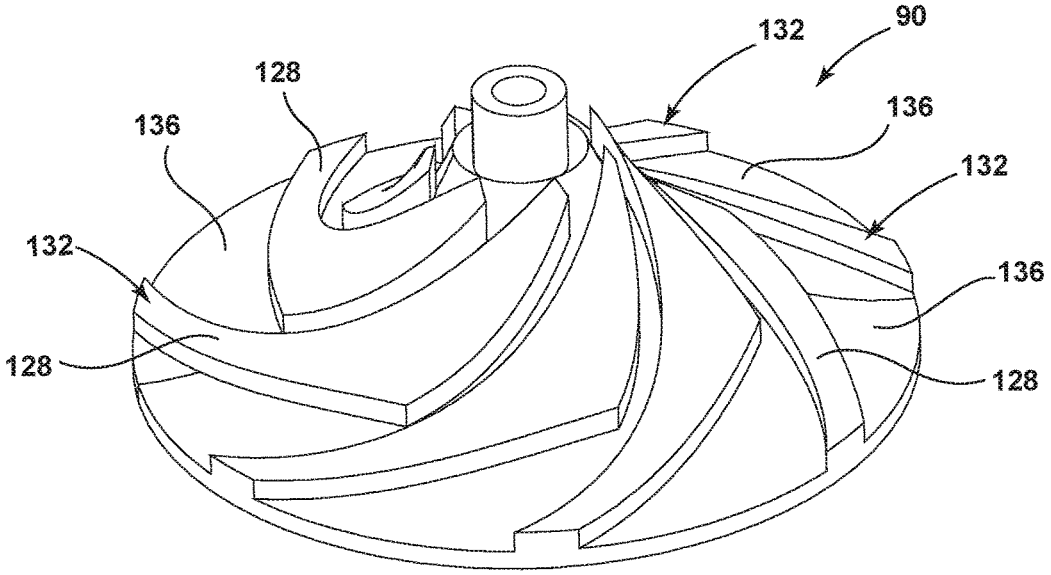
FIG. 9 illustrates a perspective view of the plug shown in FIG. 8.

Referring to FIGS. 8-9, the plug 90 engages the fan wheel 86 and closes and seals the apertures 124 of the base plate 102. The plug 90 includes plugging members 128 with adjacent plugging members 128 being spaced apart by a recess 136 formed on a top surface 132. The top surface 132 has a generally frustoconical shape. The plugging members 128 extend upward relative to the recesses 136 and are arranged circumferentially around the top surface 128.

Each plugging member 128 corresponds to one of the apertures 124 in the fan wheel 86; therefore, in the illustrated embodiment, the plug 90 includes the same number of plugging members 128 as the fan wheel 86 includes apertures 124. Each plugging member 128 is sized and shaped to fit within one of the apertures 124. When the plug 90 is inserted into the base plate 102 of the fan wheel 86, a plugging member 128 closes and seals each aperture 124 to form a continuous surface 140 within the channel 58 between adjacent blades 54. Specifically, the top surface 112 of the base plate 102 and the top surface 132 of the plug 90 are aligned to form the continuous surface 140. In other embodiments (not shown), the plugging member(s) 128 may provide a portion of a blade 54, in addition or in the alternative to closing and sealing an aperture 124 and providing the continuous surface 140.

In some embodiments, any one of the plugging members 128 can fit within any one of the apertures 124. In other embodiments, a specific plugging member 128 corresponds to a corresponding aperture 124 such that the plug 90 must be positioned in a specific orientation relative to the fan wheel 86 for assembly.

Prior to assembling the fan 10, the shroud 82, the fan wheel 86, and the plug 90 are each manufactured separately and then coupled together to form the fan 10. More specifically, each member is individually molded. For example, in one embodiment, the fan wheel 86 is molded using a first two-part mold, the plug 90 is molded using a second two-part mold, and the shroud 82 is molded using a third two-part mold.

The apertures 124 in the fan wheel 86 allow for the molding of the blades 54, with the downwardly-directed side surface 108 of each blade 54 being accessible by the lower mold part through the aperture 124. In the illustrated embodiment, the blades 54 of the fan wheel 86 do not overlap, which allows the fan wheel 86 to be molded using a simpler mold. In further embodiments, the blades 54 may overlap or the blades 54 may be formed by a straight extrusion.

Once each member is molded, the members are coupled together. In the illustrated embodiment, the members are coupled together using a welding process; however, in other embodiments, different processes are used to couple the members together.

Figure 10:
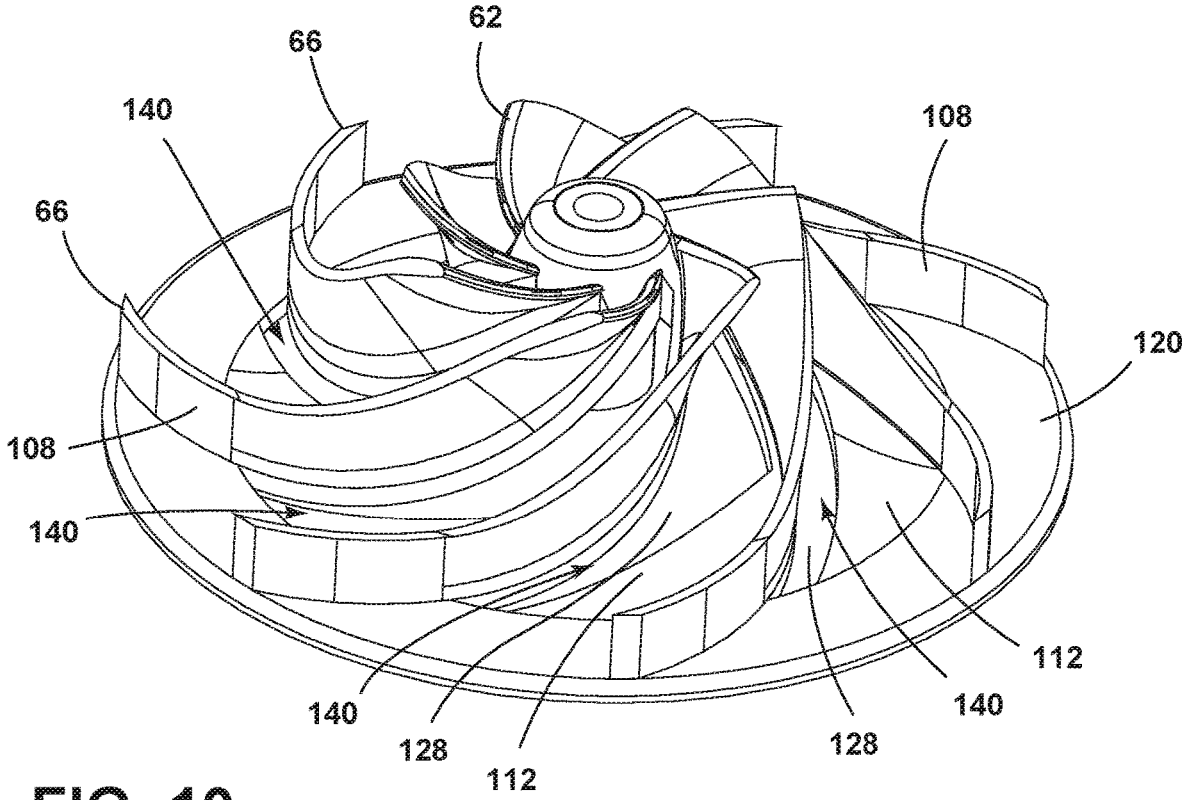
FIG. 10 illustrates a top perspective view of the fan wheel and the plug assembled.
Figure 11:
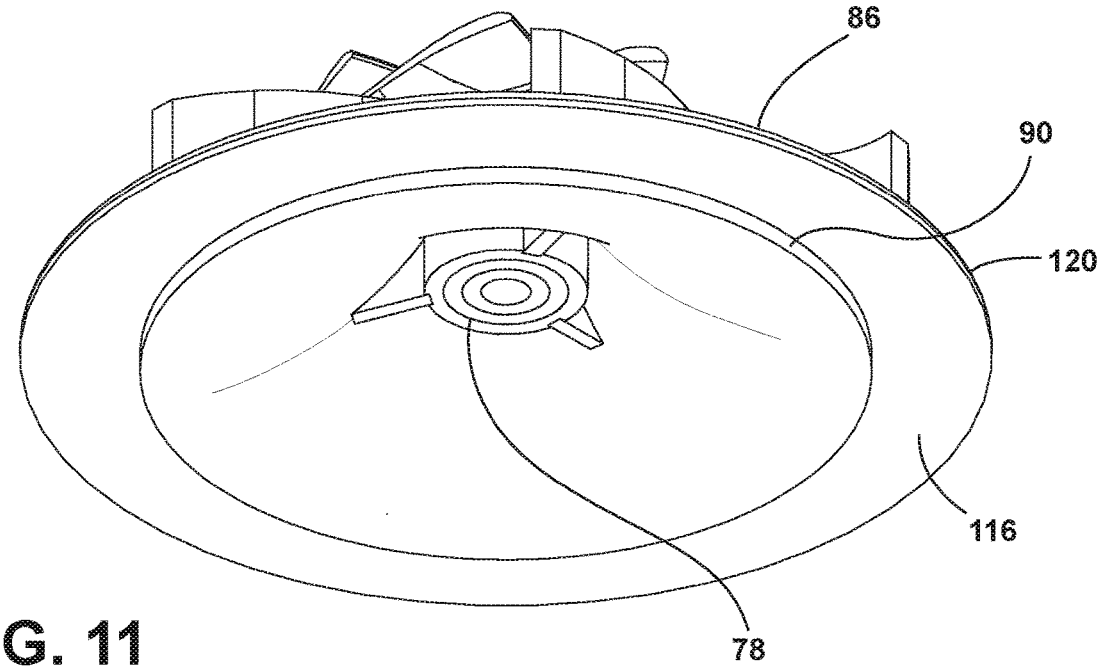
FIG. 11 illustrates a bottom perspective view of the fan wheel and the plug assembled.
Figure 12:
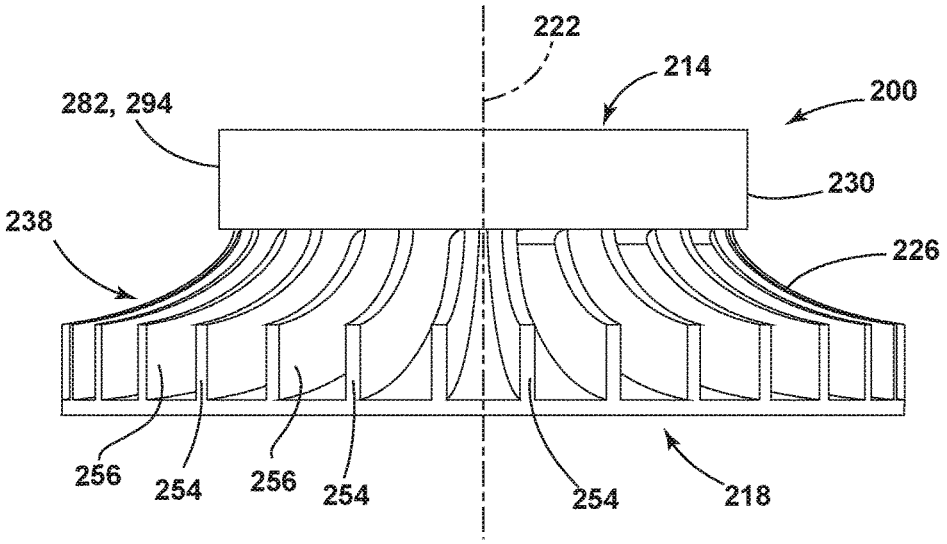
FIG. 12 illustrates a side view of another independent embodiment of a fan.

To assemble the fan 10, the plug 90 is inserted into the fan wheel 86 such that the plugging members 128 are positioned in the apertures 124 and form the continuous surface 140 within the channels 58 (see FIGS. 10-11). The shroud 82 is then coupled to the top of the fan wheel 86 such that the blades 54 support the shroud 82 at a distance from the base plate 102. FIGS. 1-4 illustrate the shroud 82, the fan wheel 86, and the plug 90 assembled together to form the fan 10. The order in which the members are coupled together can be varied. In some embodiments, the shroud 82 is not included in the fan 10.

FIGS. 12-18 illustrate a mixed flow fan 200 according to another embodiment of the invention. Similar to the fan 10 illustrated in FIGS. 1-4, the illustrated fan 200 has a circular cross-section and a frustoconical shape that tapers between a first end 214 having a first circumference and a second end 218 having a second circumference greater than the first circumference. An axis of rotation 222 extends through the center of the fan 200 between the first end 214 and the second end 218.

When viewed from the side (FIG. 12), the fan 200 includes an inclined first portion 226 that slopes radially outward and a second portion 230 that has a linear profile. The second portion 230 is defined by a shroud 282 having a cylindrical wall 294 that extends parallel with the axis of rotation 222. Blades 254 extend from the first end 214 to the second end 218 of the fan. In the illustrated embodiment, the blades 254 extend radially outward from a hub 278 that defines a hollow bore 276. In the illustrated embodiment the hub 178 is cylindrical.

The illustrated fan 200 includes two separate members—a first member or axial fan 286 and a second member or centrifugal fan 290—connected (e.g., welded) to form the fan 200. The centrifugal fan 290 forms the first portion 226 of the fan 200 and the axial fan 286 forms the second portion 230. When the axial fan 286 and the centrifugal fan 290 are assembled, the fan blades 254 extend continuously between the axial fan 286 and the centrifugal fan 290. More specifically, the axial fan 286 defines a first portion 254A and a leading end 262 of each blade 254, and the centrifugal fan 290 defines a second portion 254B and a trailing end 266 of each blade 254.

The axial fan 286 includes the first portions 254A of the blades 254, the shroud 282 and a cylindrical hub 278A. The shroud 282 defines an opening 242, which is circular in the illustrated embodiment, on a top side 246 of the fan 200 proximate the first end 214. The first portions 254A of the blades 254 are positioned within the opening 242, with the leading ends 262 positioned at an uppermost end of the opening 242. The leading ends 262 of the blades 254 are curved in a direction perpendicular to the axis of rotation 222. The opening 242 also provides an inlet 250 of the fan 200. The cylindrical hub 278A is positioned along the axis of rotation 222 and defines a bore 276A.

The first portions 254A of the blades 254 extend radially outward from the cylindrical hub 278A to the shroud 282, and channels or openings 258A are defined between adjacent blade portions 254A. With this configuration, the blade portions 254A divide the opening 242 into inlet partitions 270. In the illustrated embodiment, the blade portions 254A extend the entire distance between the hub 278A and the shroud 282; however, in further embodiments, only a portion of the blade portions 254A may extend between the hub 278A and the shroud 282.

The centrifugal fan 290 includes the second portions 254B of the blades 254, vanes 256 and a base plate 202. The base plate 202 has a conical (or frustoconical) shape that extends from an outer perimeter or edge 210, which supports the trailing ends 266 of the blades 254, to a central hub 278B, which defines a bore 276B in the centrifugal fan 290. The second blade portions 254B extend from the central hub 278B radially outward to the outer edge 210 with a recess or channel 258B defined between adjacent blade portions 254B. In the illustrated embodiment, the trailing ends 266 of the blades 254 are curved in a second direction perpendicular to the axis of rotation 222 to define the first portion 226 of the fan 200.

Further, when the fan 200 is assembled, the blades 254 extend continuously from the leading ends 262 at the axial fan 286 to the trailing ends 266 at the centrifugal fan 290. In the illustrated embodiment, the shroud 282 surrounds the first portions 254A of the blades 254 on the axial fan 286, and the second portions 254B of the blades 254 (i.e., the portions not surrounded by the shroud 282) define an outlet 238 of the fan 200.

In the illustrated embodiment, the vanes 256 are also supported by the base plate 202, and one vane 256 is positioned in each recess 258B, or between adjacent second blade portions 254B, such that the blade portions 254B and vanes 256 alternate around the base plate 202. Accordingly, the cumulative number of first portions 254B of the blades 254 and vanes 256 on the centrifugal fan 290 is twice the number of first portions 254A of the blades 254 on the axial fan 286.

Figure 18:
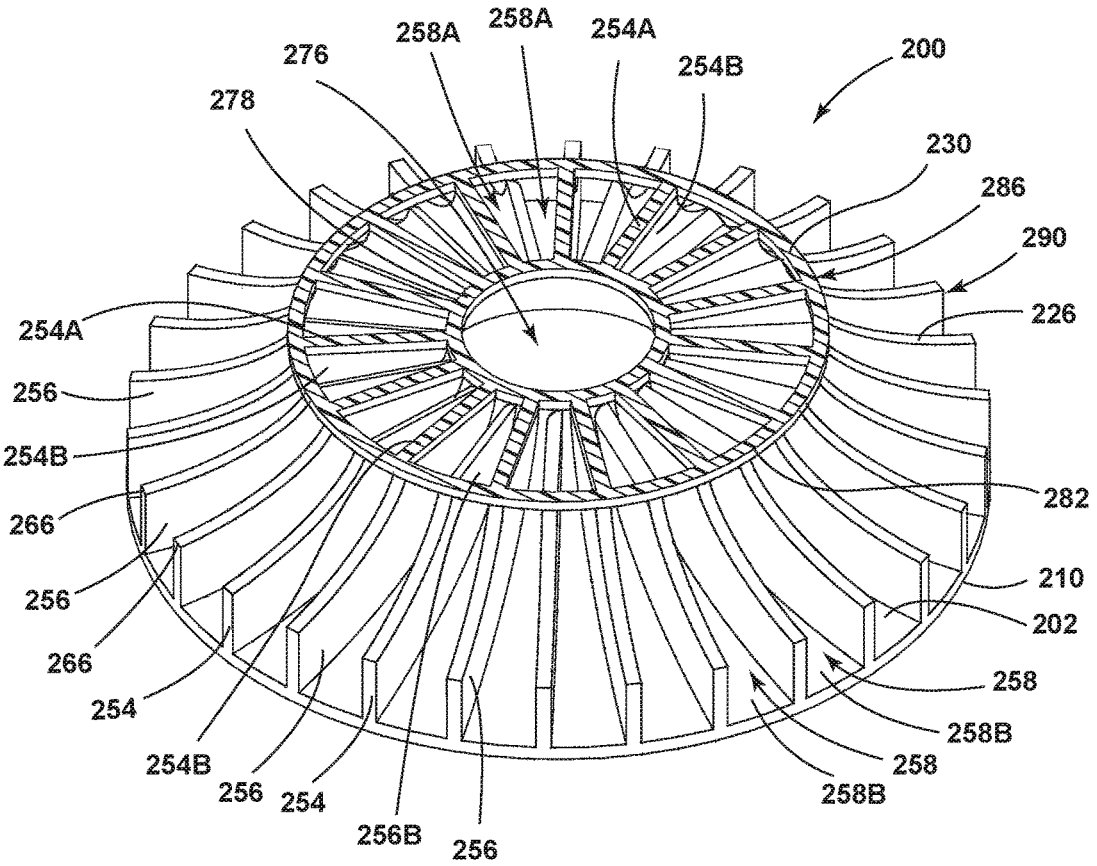
FIG. 18 illustrates a cross-sectional view of the fan of FIG. 12 with a portion of the axial fan wheel removed.

FIG. 18 shows a cross-sectional view with a portion of the axial fan 286 removed to reveal the vanes 256. The vanes 256 extend through the channels 258B to divide the recesses 258B. The vanes 256 extend for along a distance that is less than the distance between the leading ends 262 and the trailing ends 266 of the plurality of blades 254. The vanes 256 are sized and shaped identically to the second portions 254B of the blades 254; however, corresponding vanes 256 are not included with the axial fan 286. In further embodiments, there may be fewer or more vanes 256, the vanes 256 may differ in size and shape from the blade portions 254B, or the centrifugal fan 290 may not include any vanes 256.

When the axial fan 286 and the centrifugal fan 290 are assembled, channels 258, formed by the recesses 258A, 258B, extend from the inlet 250 of the fan 200, defined by the axial fan 286, to the outlet 238, defined by the centrifugal fan 290. The channels 258 enable air to flow through the fan 200 from the inlet 250 to the outlet 238. In doing so, the channels 258 also help transition the direction of the air flow from a substantially axial direction near the inlet 250 to a substantially radial direction near the outlet 238.

Figure 13:
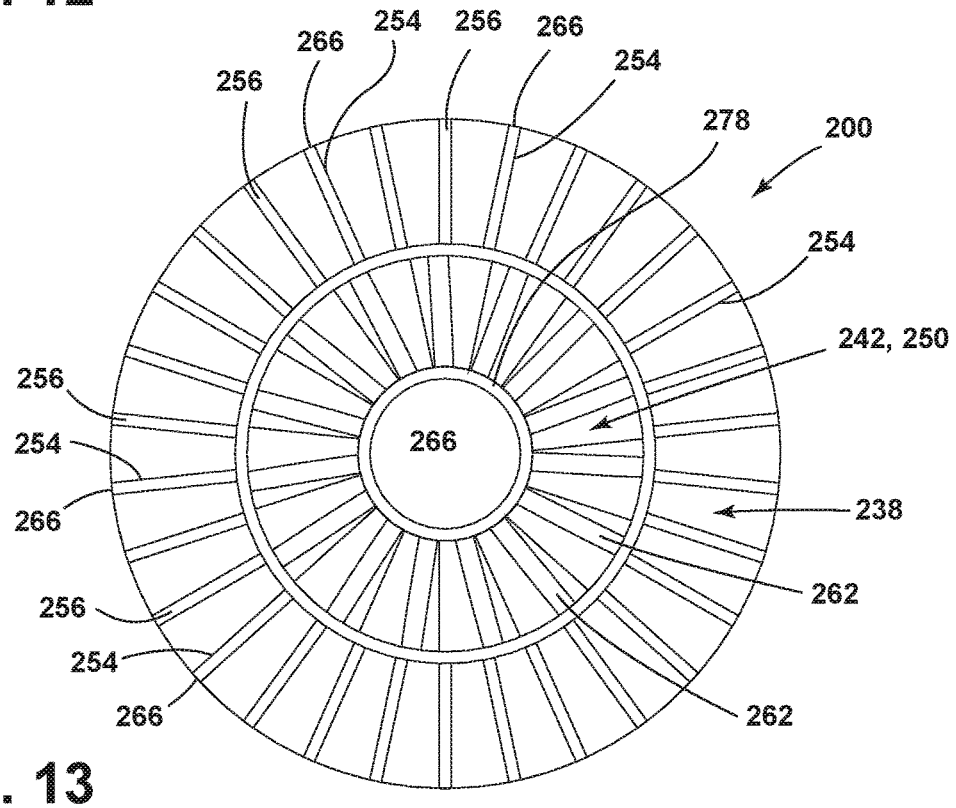
FIG. 13 illustrates a top view of the fan of FIG. 12.
Figure 14:
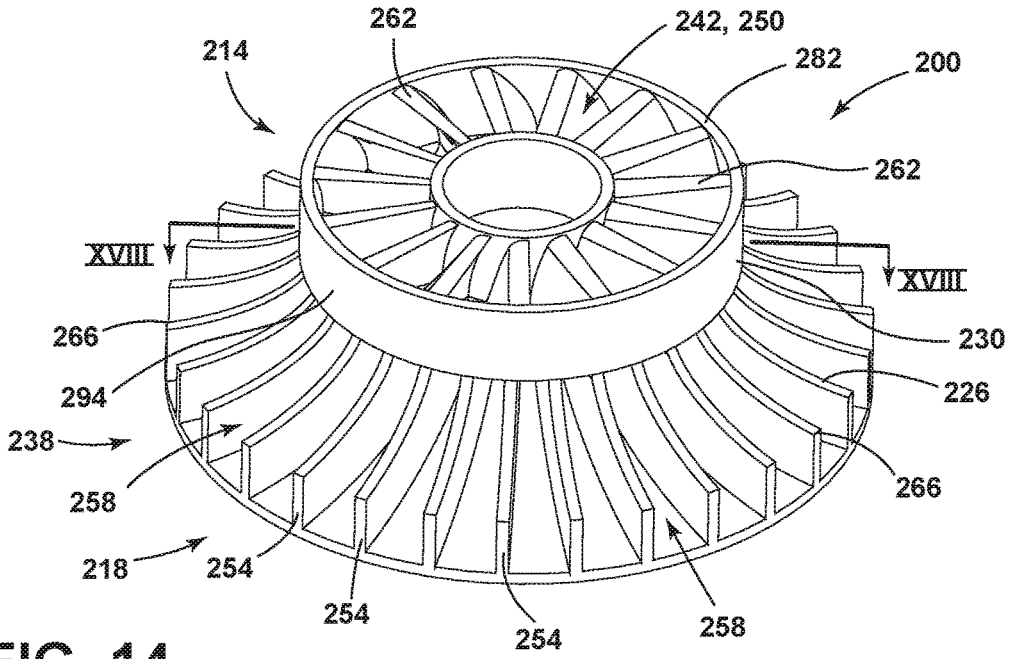
FIG. 14 illustrates a top perspective view of the fan of FIG. 12.
Figure 15:
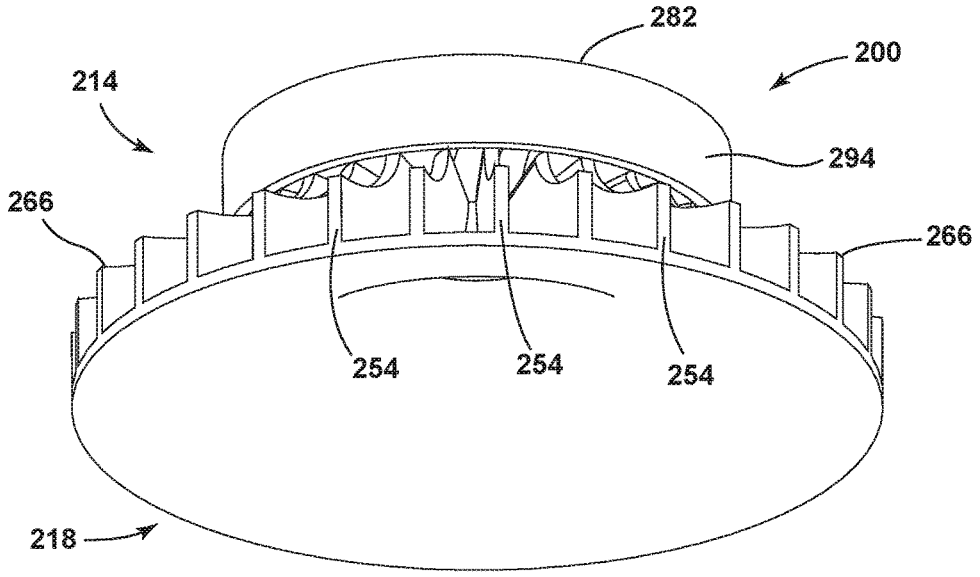
FIG. 15 illustrates a bottom perspective view of the fan of FIG. 12.
Figure 16:
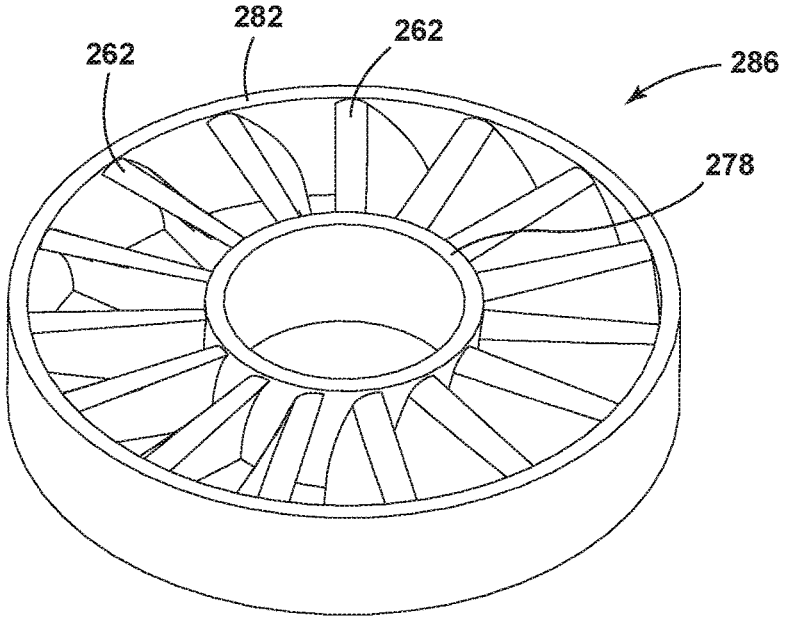
FIG. 16 illustrates an axial fan wheel for use with the fan shown in FIG. 12.
Figure 17:
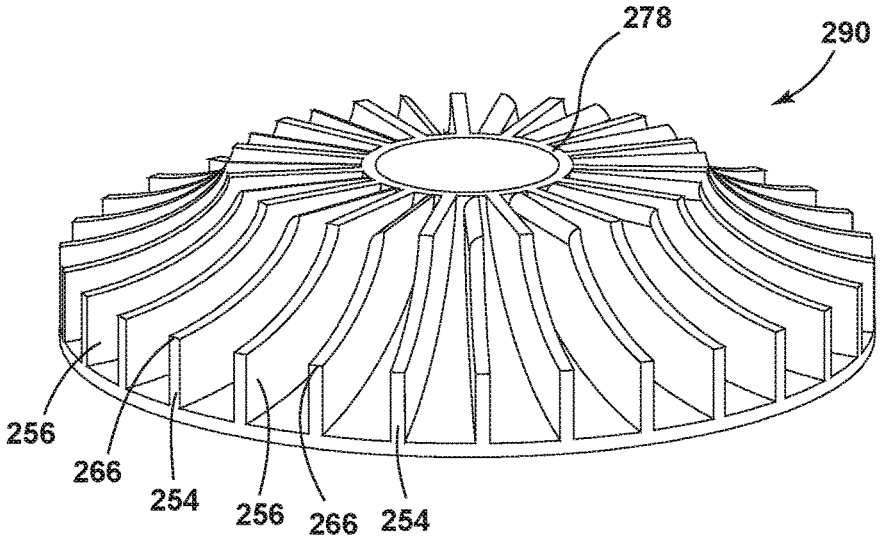
FIG. 17 illustrates a centrifugal fan wheel for use with the fan shown in FIG. 12.

As shown in FIG. 13, a portion of the axial fan 286 (e.g., the first portion 254A) axially overlaps a portion of the centrifugal fan 290 (e.g., the base plate 202 in the channel 258). In order to form this structure in a two-part mold, the axial fan 286 and the centrifugal fan 290 are each individually molded. In some embodiments, the axial fan 286 is molded using a first two-part mold, and the centrifugal fan 290 is molded using a second two-part mold. Once the members are each molded, the axial fan 286 and the centrifugal fan 290 are connected (e.g., welded) to form the fan 200.

Referring to FIG. 18, when the fan 200 is assembled, the central hub 278A and the bore 276A of the axial fan 286 are aligned and coaxial with the central hub 278B and the bore 276B of the centrifugal fan 290. In addition, the first portions 254A of the blades 254 of the axial fan 286 are aligned with the second portions 254B of the centrifugal fan 290.

FIGS. 19-23 illustrate a mixed flow fan 300 according to another embodiment of the invention. The fan has 300 three separate members, including a shroud 382, a fan wheel 386, and a plug 390 (together "the members"), connected (e.g., welded) to form the fan 300. When assembled (FIG. 19), the fan 300 has a circular cross-section and a frustoconical shape that tapers between a first end 314 having a first circumference and a second end 318 having a second circumference that is greater than the first circumference. An axis of rotation 322 extends through the center of the fan 300 between the first end 314 and the second end 318. When viewed from the side, the fan 300 includes a first portion 326 that is inclined and slopes radially outward and a second portion 330 that has a linear profile with edges that extend parallel to the axis of rotation 322.

An annular opening 334 extends around the second portion 330 of the fan 300 proximate the second end 318. The annular opening 334 defines an outlet 338 of the fan 300. The fan 300 also includes an opening 342 on a top side 346 of the fan 300 proximate the first end 314. The opening 342 defines an inlet 350 of the fan 300. Blades 354 are provided within the interior of the fan 300 and extend between the first end 314 and the second end 318. Each blade 354 includes a leading end 362 and a trailing end 366 opposite of the leading end 362. A channel 358 is formed between adjacent blades 354. The channels 358 direct air flowing through the fan from the inlet 350, where air flows in a substantially axial direction, to the outlet 338, where air flows in a substantially radial direction.

The shroud 382 has a frustoconical shape with an outer wall 394 that defines the opening 342. The outer wall 394 slopes downward and radially outward to define the inclined first portion 326 of the fan 300. The outer wall 394 curves radially outward to form a planar rim 398 at the lower end of the outer wall 394. The rim 398 engages the trailing ends 366 of the blades 54 when the fan 300 is assembled.

Figure 21:
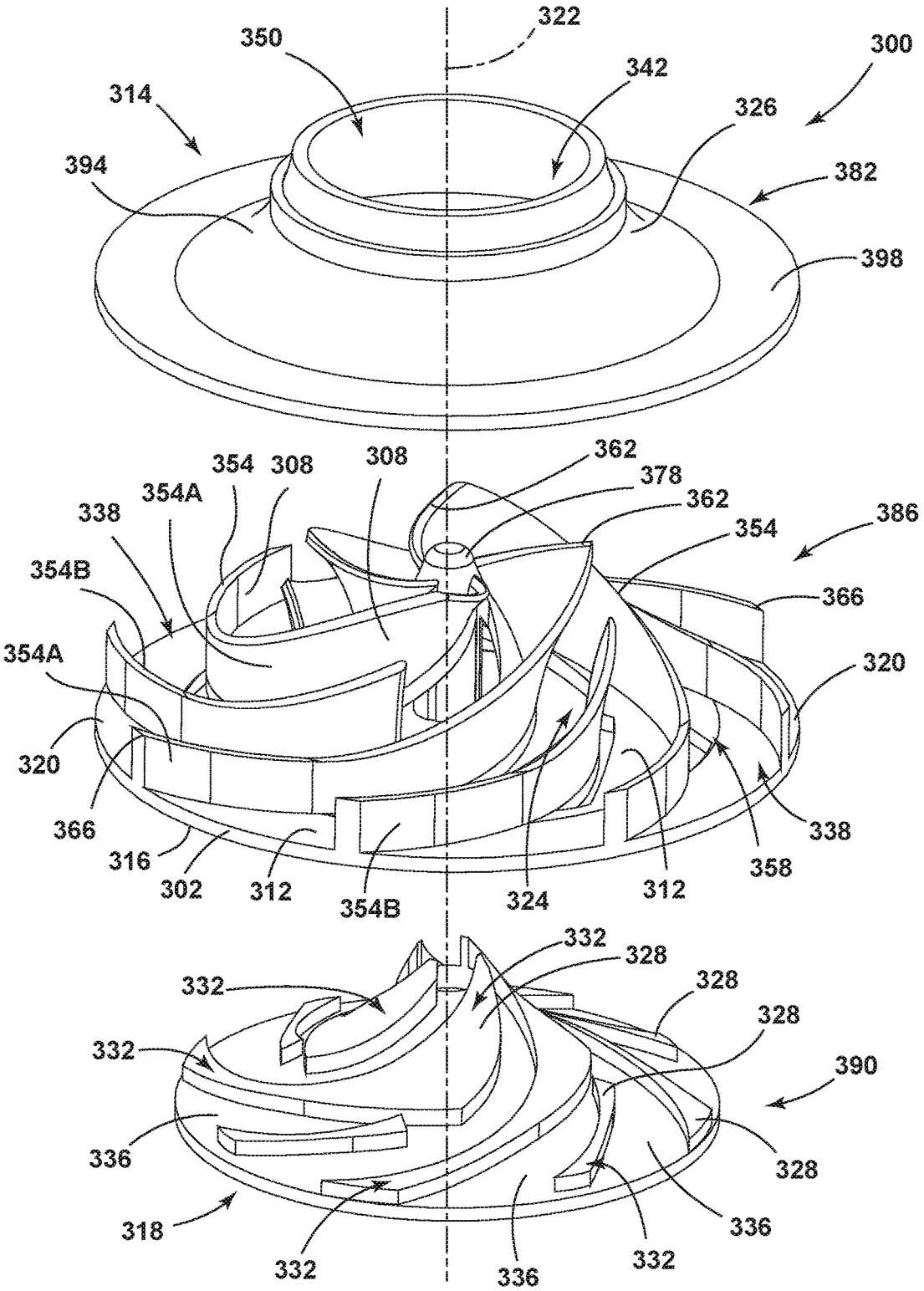
FIG. 21 illustrates an exploded view of the fan of FIG. 19.
Figure 22:
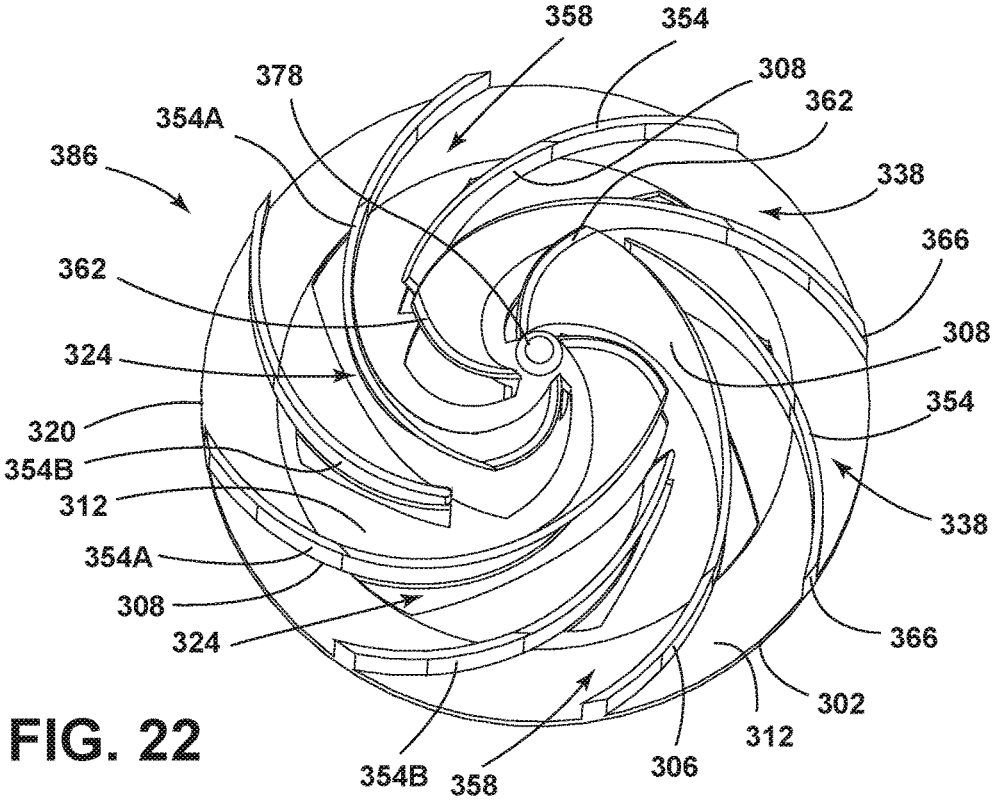
FIG. 22 illustrates top view of a fan wheel for use with the fan of FIG. 19.
Figure 23:
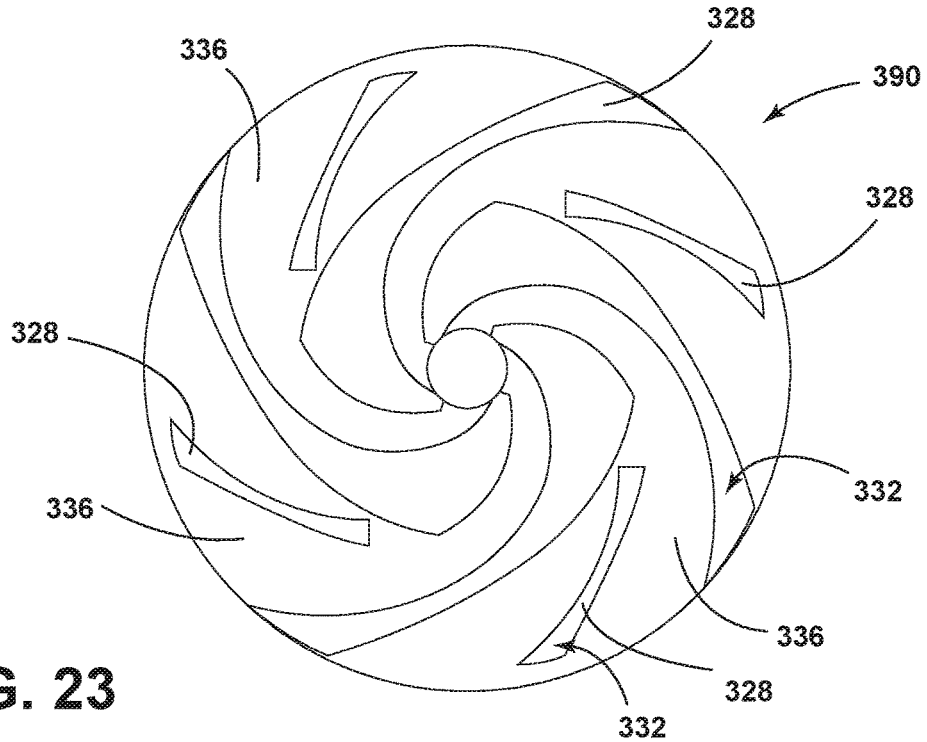
FIG. 23 illustrates a top view of a plug for use with the fan of FIG. 19.

With reference to FIGS. 21-22, the fan wheel 386 includes a hub 378, the blades 354, and a base plate 302. The hub 378 extends along the axis of rotation 322. The blades 354 extend radially outward and axially downward from the cylindrical hub 378 with the leading ends 362 positioned radially inward from the trailing ends 366. Thus, when viewed from the side, the fan wheel 386 has a frustoconical shape. Each blade 354 further includes opposing side surfaces 308 extending between the leading end 362 and the trailing end 366 of the blade 54. The air flow channels 358 are formed by the side surfaces 308 of adjacent blades 54. The curvature of the side surfaces 308 transitions the incoming airflow from a substantially axial direction to a substantially radial direction at the outlet 338.

The base plate 302 includes a top surface 312 and a bottom surface 316. The top surface 312 of the base plate 302 supports the blades 354. The base plate 302 extends from the axis of rotation 322 to the trailing ends 366 of the blades 354 on an underside of the blades 354. In the illustrated embodiment, an outer edge 320 of the base plate 302 forms a planar surface that supports the trailing ends 366 of the blades 354. The outer edge 320 aligns generally parallel with the rim 398 of the shroud 382 when the fan 300 is assembled. In the illustrated embodiment, the trailing end 366 of each blade 354 is arranged substantially perpendicular to the outer edge 320. When the fan 300 is assembled the trailing ends 366 of the blades 354 extend between the outer edge 320 of the base plate 302 and the rim 398 of the shroud 382. The blades 354 support the shroud 382 at a distance from the outer edge 320 of the base plate 302 to form the annular opening 334, and the trailing ends 366 of the blades 354 divide the annular opening 334 into the outlet partitions 374.

The blades 354 are spaced apart by apertures 324 formed within each channel 358. The apertures 324 are formed in the base plate 302, with one aperture 324 positioned between adjacent blades 354. In the illustrated embodiment, the apertures 324 extend at least partially along the side surface 308 of each blade 354. In some embodiments, each aperture 324 spans the entire width and/or length of the channels 358. In other embodiments, the apertures 324 only span a portion of the channels 358, leaving a portion of the top surface 312 of the base plate 302 visible between adjacent blades 354. The shapes and sizes of the apertures 324 may vary within a single base plate 302, or may vary from base plate 302 to base plate 302.

In the illustrated embodiment, the blades 354 include a first set of blades 354A and a second set of blades 354B. The first set of blades 354A extends the entire distance from the hub 378 to the outer edge 320 of the base plate 302. The second set of blades 354B extends from the outer edge 320 only part of the distance to the hub 378, i.e., the blades 354B are not coupled to the hub 378. The leading ends 362 of the first set of blades 354A divides the opening 342 into inlet partitions 370. The trailing ends of both the first set of blades 354A and the second set of blades 354B divide the annular opening 334 into the outlet partitions 374.

With reference to FIGS. 20-23, the plug 390 is coupled to a bottom surface of the fan wheel 386 and closes and seals the apertures 324 of the base plate 302. The plug 390 has a generally frustoconical shape and includes plugging members 328 arranged circumferentially about a top surface 332 of the plug 390. Adjacent plugging members 328 are spaced apart by a recess 336 formed on a top surface 332. Each plugging member 328 corresponds to one of the apertures 324 in the fan wheel 386; therefore, in the illustrated embodiment, the plug 390 includes the same number of plugging members 328 as the fan wheel 386 includes apertures 324.

Each plugging member 328 is sized and shaped to fit within one of the apertures 324, and thereby closes and seals the aperture 324 when the fan 300 is assembled. In the illustrated embodiment, the plugging members 328 have two different sizes and shapes corresponding to the different sets of blades 354A, 354B. In some embodiments any one of the plugging members 328 can fit within any one of the apertures 324. In other embodiments, a specific plugging member 328 corresponds to each aperture 324.

When the plug 390 is inserted into the base plate 302 of the fan wheel 386, a plugging member 328 closes and seals each aperture 324 such that a continuous surface 340 (FIG. 20) is formed within the channel 358 between each pair of adjacent blades 354. Specifically, the top surface 312 of the base plate 302 and the top surface 332 of the plug 390 are aligned to form the continuous surface 340.

Prior to assembling the fan 300, the shroud 382, the fan wheel 386, and the plug 390 are each manufactured separately, and then coupled together to form the fan 300. For example, in one embodiment, each member is individually molded using a two-part mold. Once each member is molded, the members are coupled together. In the illustrated embodiment, the members are coupled together using a welding process; however, in other embodiments, different processes are used to couple the members together.

Figure 19:
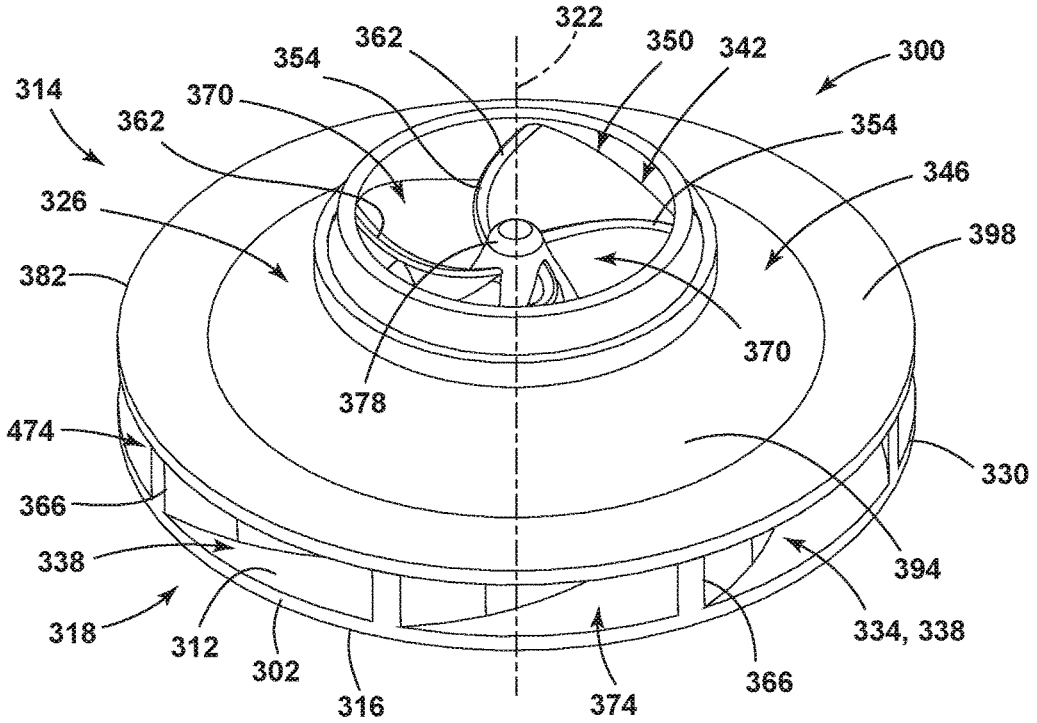
FIG. 19 illustrates another independent embodiment of a mixed flow fan.
Figure 20:
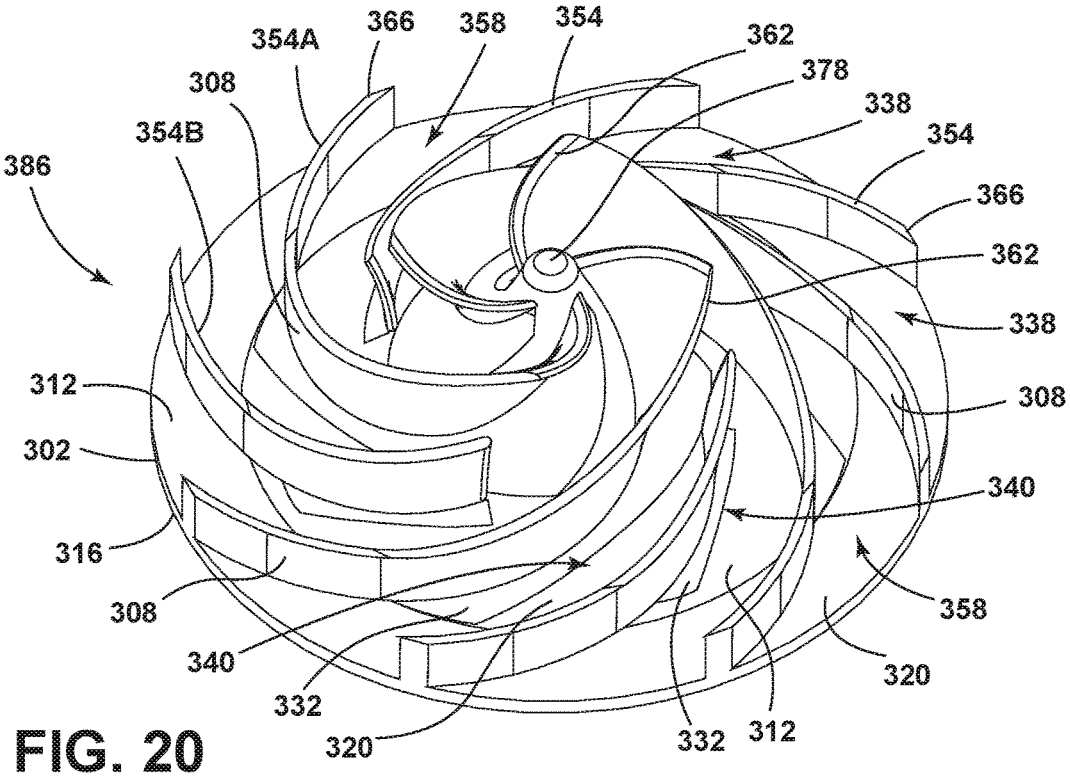
FIG. 20 illustrates a perspective view of the fan of FIG. 19 with a shroud removed.

To assemble the fan 300, the plug 390 is inserted into the fan wheel 386 such that the plugging members 328 close and seal the apertures 324 and form the continuous surface 340 within the channels 358. The shroud 382 is then coupled to the top of the fan wheel 386 such that the blades 54 support the shroud 382 at a distance from the base plate 302. FIG. 19 illustrates the shroud 382, the fan wheel 386, and the plug 390 assembled together to form the fan 300.

FIGS. 24-28 illustrate a mixed flow fan 400 according to another embodiment of the invention. The fan 400 includes three separate members, including a shroud 482, a fan wheel 486, and a plug 490 (together "the members"), connected (e.g., welded) to form the fan 400. One difference between the embodiment of FIGS. 24-28 and the embodiments illustrated in FIGS. 1-11 and 19-23 is that the plug 490 is coupled to a top side of the fan wheel 486 above the blades 454, and the shroud 482 is coupled to the underside of the fan wheel 486 along a bottom edge of the blades 454.

When assembled (FIG. 28), the fan 400 has circular cross-section and a frustoconical shape that tapers between a first end 414 having a first circumference and a second end 418 having a second circumference that is greater than the first circumference. An axis of rotation 422 extends through the center of the fan 400 between the first end 414 and the second end 418. When viewed from the side, the fan 400 includes an inclined first portion 426 that slopes radially outward and a second portion 430 that has a linear profile with edges that extend parallel with the axis of rotation 422.

An annular opening 434 extends around the second portion 430 of the fan 400 proximate the second end 418. The annular opening 434 defines an outlet 438 of the fan 400. The fan 400 also includes an opening 442 on a top side 446 of the fan 400 proximate the first end 414. The opening 442 defines an inlet 450 of the fan 400. Blades 454 are provided within the interior of the fan 400 and extend between the first end 414 and the second end 418. Each blade 454 includes a leading end 462 and a trailing end 466 opposite of the leading end 462. A channel 458 is formed between adjacent blades 454. The channels 458 direct air flowing through the fan 400 from the inlet 450, where air flows in a substantially axial direction, to the outlet 438, where air flows in a substantially radial direction.

The shroud 482 has a frustoconical shape formed by an outer wall 494. The outer wall 494 slopes downward and radially outward from the axis of rotation 422 to form a planar rim 498 at the lower end of the outer wall 494. The outer wall 494 of the shroud 482 supports the blades 454. Specifically, the outer wall 494 extends from the axis of rotation 422 to the trailing ends 466 of the blades 454 on an underside of the blades 454. In addition, the rim 498 forms a planar surface that supports the trailing ends 466 of the blades 454.

Figure 24:
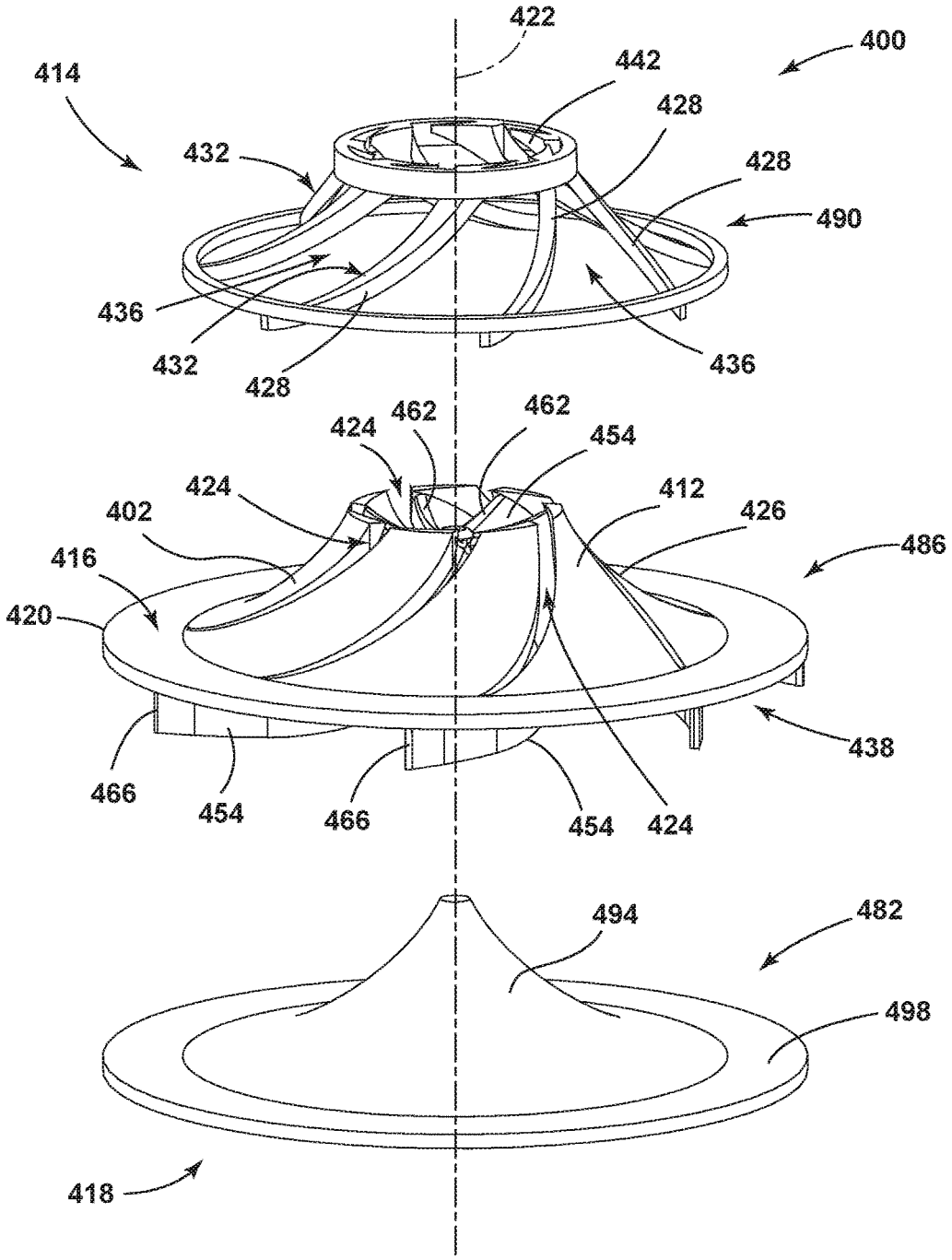
FIG. 24 illustrates an exploded view of another independent embodiment of a fan.
Figure 25:
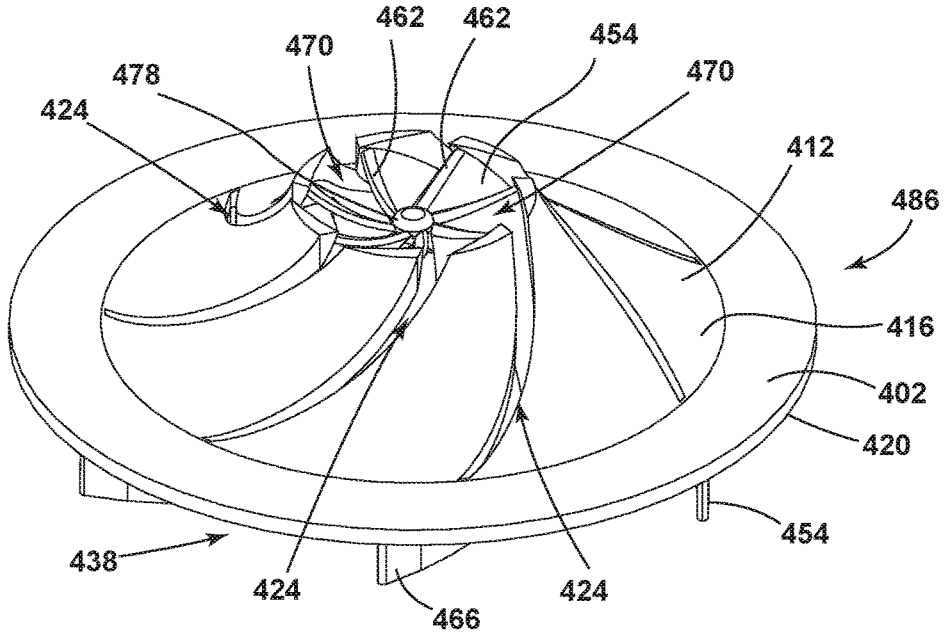
FIG. 25 illustrates top perspective view of a fan wheel for use with the fan of FIG. 24.
Figure 26:
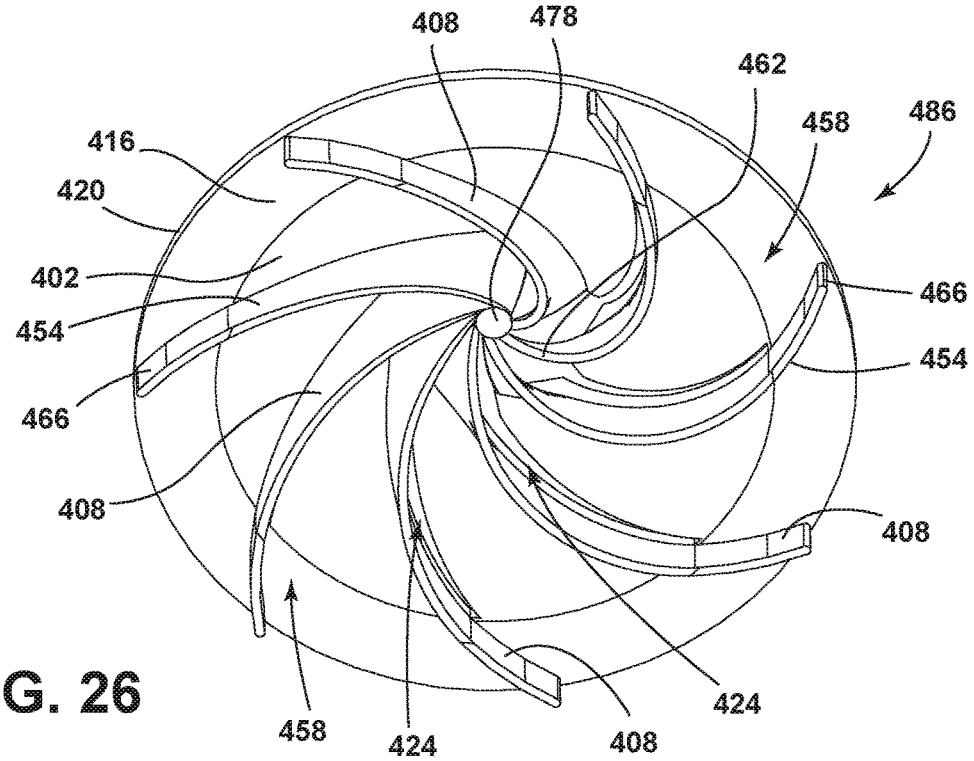
FIG. 26 illustrates a bottom perspective view of the fan wheel of FIG. 25.

Referring to FIGS. 24-26, the fan wheel 486 includes a hub 478, the blades 454, and a base plate 402. The blades 454 project from a bottom surface of the base plate 402, and extend radially outward and axially downward from the hub 478 with the leading ends 462 positioned radially inward from the trailing ends 466. Thus, when viewed from the side, the fan wheel 486 has a frustoconical shape. Each blade 454 further includes opposing side surfaces 408 extending between the leading end 462 and the trailing end 466 of the blade 454. The air flow channels 458 are formed by the side surfaces 408 of adjacent blades 454. The curvature of the side surfaces 408 transitions the incoming airflow from a substantially axial direction to a substantially radial direction at the outlet 438.

The base plate 402 has a frustoconical shape that slopes downward and radially outward to define the inclined first portion 426 of the fan 400. The base plate 402 includes a top surface 412 and a bottom surface 416, whereby, in this embodiment, the bottom surface 416 of the base plate 402 supports the blades 454. The base plate 402 extends from the axis of rotation 422 to the trailing ends 466 of the blades 454 on a top side of the blades 454.

In the illustrated embodiment, an outer edge 420 of the base plate 402 forms a planar surface along the trailing ends 466 of the blades 454. The outer edge 420 aligns generally parallel with the rim 498 of the lower shroud 482 when the fan 400 is assembled. In the illustrated embodiment, the trailing end 466 of each blade 454 is arranged substantially perpendicular to the outer edge 420. When the fan 400 is assembled, the trailing ends 466 of the blades 454 extend between the outer edge 420 of the base plate 402 and the rim 498 of the shroud 482. The blades 454 maintain the shroud 482 at a distance from the outer edge 420 of the base plate 402 to form the annular opening 434, and the trailing ends 466 of the blades 454 divide the annular opening 434 into the outlet partitions 474.

The blades 454 are spaced apart by apertures 424 formed in the base plate 402 and positioned within each channel 458. In the illustrated embodiment, one aperture 424 is positioned between each pair of adjacent blades 454. In the illustrated embodiment, the apertures 424 extend at least partially along the side surface 408 of each blade 454. In some embodiments, each aperture 424 spans the entire width and/or length of the channels 458. In other embodiments, the apertures 424 only span a portion of the channels 458, leaving a portion of the top surface 412 of the base plate 402 visible between adjacent blades 454. The shapes and sizes of the apertures 424 may vary within a single base plate 402, or may vary from base plate 402 to base plate 402.

Figure 27:
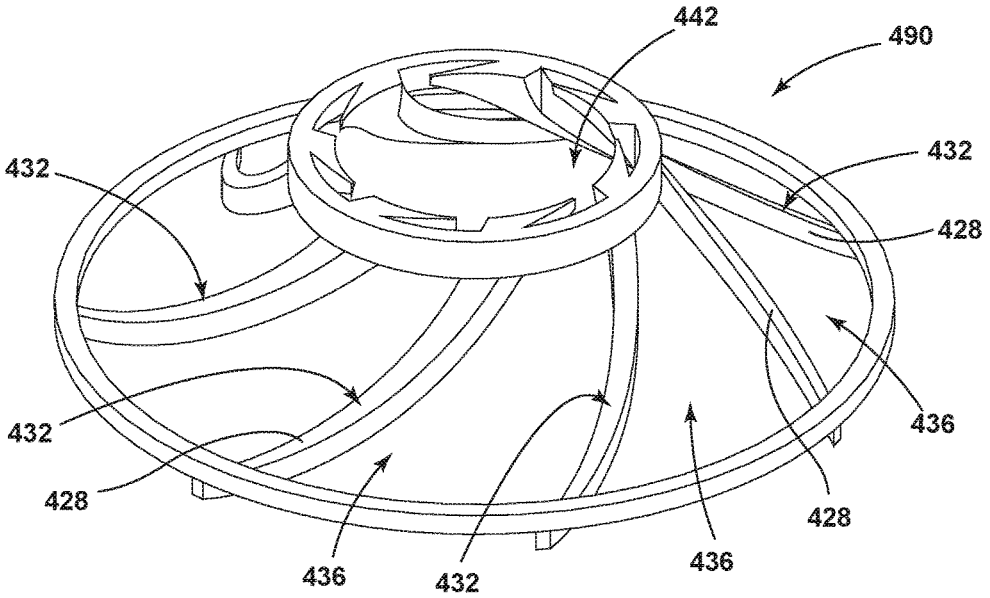
FIG. 27 illustrates a top perspective view of a shroud for use with the fan of FIG. 24.

Referring to FIGS. 24 and 27, the plug 490 has a frustoconical shape that defines the opening 442 at the first end 414 of the fan 400. The plug 490 is coupled to a top surface 412 of the fan wheel 486 and seals the apertures 424 of the base plate 402. The plug 490 includes plugging members 428 with adjacent plugging member 428 spaced apart by an opening 436. The plugging members 428 are arranged circumferentially around the plug 490.

Each plugging member 428 corresponds to one of the apertures 424 in the fan wheel 486; therefore, in the illustrated embodiment, the plug 490 includes the same number of plugging members 428 as the fan wheel 486 includes apertures 424. Each plugging member 428 is sized and shaped to fit within one of the apertures 424. When the plug 490 is inserted into the base plate 402 of the fan wheel 486, a plugging member 428 closes and seals each aperture 424 such that the continuous surface 440 is formed within the channel 458 between each pair of adjacent blades 454. In other embodiments, a specific plugging member 428 corresponds to each aperture 422.

Prior to assembling the fan 400, the shroud 482, the fan wheel 486, and the plug 490 are each manufactured separately, and then coupled together to form the fan 400. More specifically, each member is individually molded. For example, in one embodiment, the fan wheel 486 is molded using a first two-part mold, the plug 490 is molded using a second two-part mold, and the shroud 482 is molded using a third two-part mold. Once each member is molded, the members are coupled together. In the illustrated embodiment, the members are coupled together using a welding process; however, in other embodiments, different processes are used to couple the members together.

Figure 28:
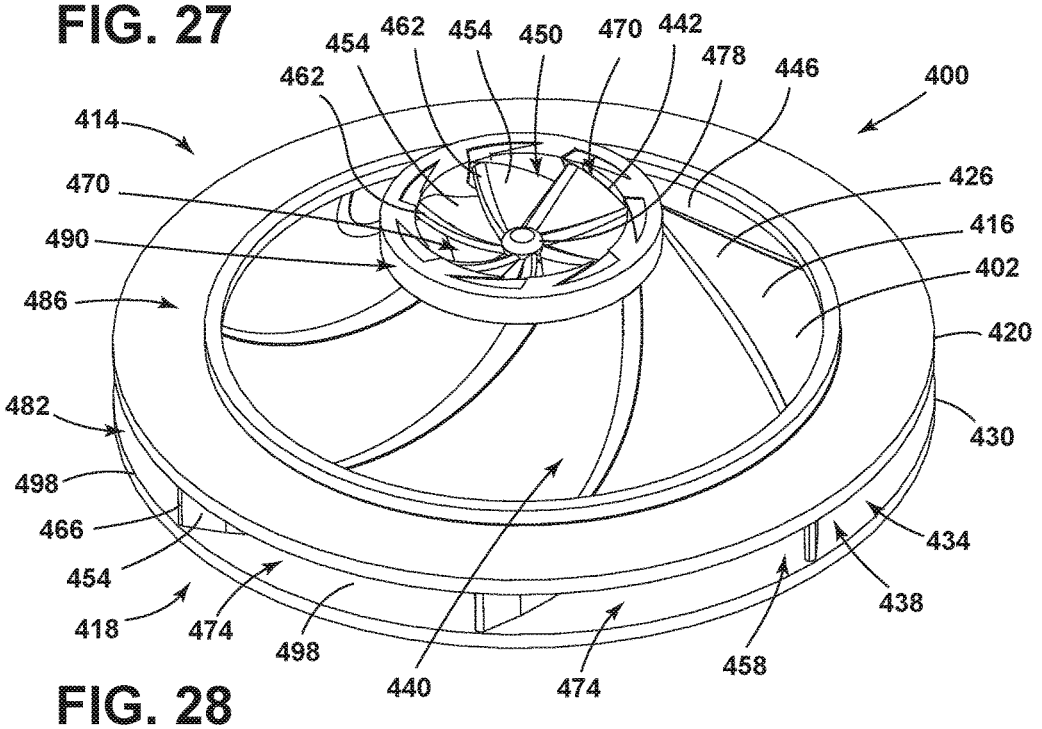
FIG. 28 illustrates a perspective view of the fan of FIG. 24 assembled.

To assemble the fan 400, the plug 490 is inserted into the fan wheel 486 such that the plugging members 428 seal the apertures 424 and form the continuous surface 440 within the channels 458. FIG. 28 illustrates the shroud 482, the fan wheel 486 and the plug 490 assembled.

Although the invention has been described with reference to certain preferred embodiments, variations and modifications exit within the spirit and scope of the present invention. Various independent embodiments of the fans disclosed herein can be incorporated into a variety of products including, but not limited to a vacuum cleaner, a wet/dry vacuum, a cooling fan for a power tool, etc. Furthermore, barring conflict of structure and assembly, the features of each independent embodiment can be combined to create alternative embodiments. The details and variations described with respect to a specific independent embodiment apply equally to other embodiments.

One or more independent features and/or independent advantages of the invention may be set forth in the following claims:

What is claimed is:

1. A fan comprising:

a fan wheel defining an axis of rotation, the fan wheel having a frustoconical shape;

a plurality of blades extending radially outward from the axis of rotation, each of the plurality of blades having a leading end and a trailing end, the leading end being radially inward of the trailing end;

a base plate supporting the plurality of blades, the base plate defining a plurality of apertures formed as through holes in the base plate, each pair of adjacent blades being spaced apart by one of the plurality of apertures; and a plug configured to engage the fan wheel, the plug including a plurality of plugging members, the plurality of plugging members forming a frustoconical shape;

wherein, when the plug is engaged with the fan wheel, each plugging member is inserted into a corresponding aperture of the plurality of apertures, each plugging member closing the corresponding aperture to form a continuous surface between the adjacent blades, the continuous surface being formed by the plugging member and a top surface of the base plate.

2. The fan of claim 1, wherein the fan wheel has the frustoconical shape with a first circumference on a first end and a second circumference on a second end, the second circumference being greater than the first circumference, the axis of rotation of the fan wheel extending through the first end and the second end.

3. The fan of claim 2, further comprising a shroud having a frustoconical shape.

4. The fan of claim 1, wherein the trailing ends of the plurality of blades are perpendicular to the axis of rotation.

5. The fan of claim 1, wherein, when viewed along the axis of rotation, each of the plurality of blades extends from the leading end to the trailing end without overlapping another one of the plurality of blades.

6. The fan of claim 1, wherein the fan wheel includes a hub, and wherein the leading end of each of the plurality of blades extends radially outward from the hub.

7. The fan of claim 1, wherein the plurality of blades are curved in a radial direction.

8. The fan of claim 7, wherein the plurality of blades are curved in an axial direction.

9. The fan of claim 1, wherein, when viewed from a side profile, the fan includes an inclined first portion sloping radially outward and a second portion having a linear profile.

10. The fan of claim 1, wherein, when viewed along the axis of rotation, at least a portion of each aperture is spaced apart from an adjacent one of the plurality of blades such that the aperture does not extend the entire distance between two adjacent blades.

11. The fan of claim 1, wherein, when viewed along the axis of rotation, each of the plurality of blades has a portion extending over at least a portion of the corresponding aperture.

12. A method of manufacturing a mixed flow fan, the method comprising:

molding a fan wheel with a plurality of blades extending radially outward from an axis of rotation and a base plate supporting the plurality of blades, the base plate defining a plurality of apertures formed as through holes in the base plate, the plurality of apertures arranged with one aperture positioned between adjacent blades, each of the plurality of blades including a leading end and a trailing end, the plurality of blades forming a frustoconical shape between the leading ends and the trailing ends of the plurality of blades;

molding a plug including a plurality of plugging members arranged circumferentially, the plurality of plugging members forming a frustoconical shape, a number of the plurality of plugging members corresponding to a number of the plurality of apertures in the fan wheel; and connecting the fan wheel and the plug with each of the plurality of apertures of the fan wheel receiving a corresponding one of the plurality of plugging members of the plug to close the aperture.

13. The method of claim 12, wherein connecting includes welding the fan wheel and the plug.

14. The method of claim 12, further comprising:

molding a shroud having a frustoconical shape; and connecting the shroud to the fan wheel.

15. The method of claim 12, wherein molding the fan wheel includes molding the fan wheel with a first two-part mold, and wherein molding the plug includes molding the plug with a second two-part mold.

16. The method of claim 12, wherein molding the fan wheel includes molding the plurality of blades such that the blades curve in a radial direction and an axial direction.

17. A fan comprising:

a first member forming a first portion of the fan, the first member defining an axis of rotation and including a plurality of blades extending radially outward from the axis of rotation, and a base plate supporting the plurality of blades, the base plate defining a plurality of apertures formed as through holes in the base plate, each one of the plurality of apertures positioned between adjacent blades of the plurality of blades, wherein each of the plurality of blades overlaps one of the plurality of apertures when viewed along the axis of rotation; and a second member formed separately from the first member and forming a second portion of the fan, the second member being connectable to the first member with a portion of the second member being insertable into a corresponding one of the plurality of the apertures of the first member to form a continuous surface with a top surface of the base plate.

18. The fan of claim 17, wherein the first member includes a fan wheel, wherein the second member includes a plug including a plurality of plugging members, and wherein, when the plug is engaged with the fan wheel, each plugging member is inserted into a corresponding aperture of the plurality of apertures, each plugging member closing the corresponding aperture to form a continuous surface between adjacent blades.

* * * * *